US011274666B2

(12) United States Patent
Yan

(10) Patent No.: US 11,274,666 B2
(45) Date of Patent: Mar. 15, 2022

(54) MICRO-FLUID PUMP

(71) Applicant: XIAMEN CONJOIN ELECTRONICS TECHNOLOGY CO., LTD., Fujian (CN)

(72) Inventor: Hong Yan, Fujian (CN)

(73) Assignee: XIAMEN CONJOIN ELECTRONICS TECHNOLOGY CO., LTD., Xiamen (CN)

( * ) Notice: Subject to any disclaimer, the term of this patent is extended or adjusted under 35 U.S.C. 154(b) by 614 days.

(21) Appl. No.: 16/056,749

(22) Filed: Aug. 7, 2018

(65) Prior Publication Data

US 2019/0063416 A1 Feb. 28, 2019

(30) Foreign Application Priority Data

Aug. 30, 2017 (CN) ..... 201721102535.5
Aug. 30, 2017 (CN) ..... 201721102623.5
(Continued)

(51) Int. Cl.
*F04B 43/02* (2006.01)
*F04B 13/00* (2006.01)
(Continued)

(52) U.S. Cl.
CPC ..... *F04B 43/026* (2013.01); *F04B 13/00* (2013.01); *F04B 19/006* (2013.01); *F04B 53/1047* (2013.01); *F04B 53/16* (2013.01)

(58) Field of Classification Search
CPC .... F04B 43/026; F04B 43/028; F04B 43/043; F04B 53/1047; F04B 19/006; F04B 13/00;
(Continued)

(56) References Cited

U.S. PATENT DOCUMENTS 8,449,267 B2 * 5/2013 Pascual ..... F04B 43/0054 417/269
2003/0086803 A1 * 5/2003 Fukami ..... F04B 43/026 417/566
(Continued)

FOREIGN PATENT DOCUMENTS

CN 202250732 U * 5/2012 ..... F04B 45/047
CN 202883327 U 4/2013
(Continued)

*Primary Examiner* — Charles G Freay
*Assistant Examiner* — Chirag Jariwala
(74) *Attorney, Agent, or Firm* — Scully Scott Murphy & Presser

(57) ABSTRACT

Embodiments of the disclosure provide a micro-fluid pump having a pump cover with a distribution wall, a one-way valve having a spark surface, and a micro-fluid pump including such a one-way valve as well as a micro fluid pump including a diaphragm deformation control structure. The pump having the pump cover with the distribution wall includes a pump body. The pump cover overlies the pump body to form at least a portion of the inlet passage and at least a portion of the discharge passage, and includes an inlet cavity for containing fluid entering the micro-fluid pump from the outside and a discharge cavity for containing fluid to be discharged from the micro-fluid pump, which cavities are separated by an isolation portion. The pump cover has on its bottom surface a distribution wall which is disposed in the inlet cavity and extends at least partially toward the partition portion.

18 Claims, 13 Drawing Sheets

(30) Foreign Application Priority Data

| | | |
|---|---|---|
| Aug. 30, 2017 | (CN) | 201721102787.X |
| Aug. 30, 2017 | (CN) | CN201721102229 |
| Aug. 30, 2017 | (CN) | CN201721102416 |
| Feb. 5, 2018 | (CN) | 201820194125.6 |
| Feb. 5, 2018 | (CN) | 201820198314.0 |
| Feb. 5, 2018 | (CN) | 201820200569.6 |

(51) Int. Cl.
*F04B 53/10* (2006.01)
*F04B 19/00* (2006.01)
*F04B 53/16* (2006.01)

(58) Field of Classification Search
CPC .. F04B 43/02; F04B 43/0009; F04B 43/0054; F04B 43/04; F04B 45/043; F04B 45/053; F04B 53/16
See application file for complete search history.

(56) References Cited

U.S. PATENT DOCUMENTS

| | | | | |
|---|---|---|---|---|
| 2016/0040664 | A1* | 2/2016 | Zhang | F04B 53/1065 417/473 |
| 2018/0320681 | A1* | 11/2018 | Chang | F04B 43/0054 |

FOREIGN PATENT DOCUMENTS

| | | | | | |
|---|---|---|---|---|---|
| CN | 202883328 | U | | 4/2013 | |
| CN | 204610210 | U | | 9/2015 | |
| CN | 204610217 | U | | 9/2015 | |
| CN | 204900208 | U | | 12/2015 | |
| CN | 205025738 | U | * | 2/2016 | F04B 45/022 |
| CN | 105927516 | A | | 9/2016 | |
| JP | 2000054961 | A | * | 2/2000 | F04B 27/1009 |

* cited by examiner

MICRO-FLUID PUMP

This application claims the benefit of Chinese Utility Models No. 201721102623.5, No. 201721102535.5, No. 201721102229.1, No. 201721102787.8 and No. 201721102416.X filed on Aug. 30, 2017, and No. 201820194125.6, No. 201820198314.0 and No. 201820200569.6 filed on Feb. 5, 2018, which are hereby entirely incorporated by reference as part of the present application.

TECHNICAL FIELD

Embodiments of the present disclosure relates to a micro-fluid pump, a check valve and a micro-fluid pump with advantageous diaphragm assembly.

BACKGROUND

A micro-fluid pump is used to introduce fluid, such as liquid or gas (for example water or air), into a body of the pump, to pressurize the fluid and then to discharge the fluid out of the pump with predetermined parameters. The micro-fluid pump is a small and sophisticated component and its pump body generally has a length of only a few centimeters, so that each of components of the pump has a small volume. Also there is a high requirement for the discharge accuracy and stability of the pump with a tolerance not exceeding 3% generally. The performance of the pump has a significant impact on the performance of the product installed with the pump.

Taking a water pump as an example, a micro-fluid pump typically includes a cover having a water inlet through which the fluid enters the pump body and a water outlet through which the fluid exits the pump Depending on the different applications of the micro-fluid pump, the above predetermined parameters may be the pressure, temperature, flow rate, total volume or the like of the fluid being discharged. These parameters impact the performance of the pump.

For example, water capsule, as a key component for suction and discharge, may impact the accuracy and stability described above. For example, the over expansion of the water capsule may cause over water yield and causes the interference between among components simultaneously. Poor sealing between the water capsule and other components may cause water leakage. Additionally, the fluid pump has a cover which is typically manufactured by injection molding and can be assembled with other components of the pump, for example by welding. Taking a diaphragm pump as an example, the pump cover formed by injection molding is easily to be deformed in use, for example due to the fluid pressure pulses continuously generated being capable of motivating the vibrations of the diaphragm pump, causing a risk of fluid leakage. Also, for example, the fluid pump may be provided with a valve for covering a flow path, which valve opens under the action of the fluid to allow the fluid to pass through and closes after the passing of fluid to prevent fluid backflow. It is a key component for controlling the performance (for example flow, noise and the like) of the fluid pump and must have good sealing as well as opening and closing responsiveness.

In addition, in some cases it is desirable to have the pump noise as low as possible.

SUMMARY

According to an embodiment of the present disclosure, a micro-fluid pump capable of controlling flow precisely is provided and comprises: a pump body; and a pump cover covering the pump body to form at least a portion of an inlet passage and at least a portion of an discharge passage, the pump cover comprising an inlet cavity for containing fluid entering the micro-fluid pump from outside and a discharge cavity for containing fluid to be discharged from the micro-fluid pump, separated by a partition portion. Said pump cover has on its bottom face distribution wall which is disposed in the inlet cavity and extends at least partially toward the partition portion.

For example, the inlet cavity is disposed around the discharge cavity and has an inlet cavity outer wall from which the distribution wall extend partially toward the partition portion or to the partition portion.

For example, the distribution wall extends radially.

For example, the pump cover has a plurality distribution walls which are spaced at a regular angle with respect to the center of the pump cover in order to divide the inlet cavity into a plurality of inlet sub-cavities.

For example, the micro-fluid pump is assembled by a snap spring, and a recess for the snap spring is provided on a top face of the pump cover, the position of the recess corresponding to the position of the distribution wall on the bottom face of the pump cover.

For example, the pump body comprises a valve seat on which an outflow passage for discharging fluid is provided, the outflow passage forming at least a portion of the discharge passage of the micro-fluid pump, the valve seat is further mounted with a one-way discharge valve which is located between the valve seat and the pump cover and has a flexible valve flap covering the outflow passage, a side of the valve flap facing the valve seat and covering the outflow passage being formed as a spark surface.

For example, the pump body comprises a valve seat having a fluid passage for introducing the fluid and/or for discharging the fluid, and wherein the valve seat is provided with a one-way valve for the respective corresponding fluid passage which is an umbrella valve with a umbrella face which has a first side covering the respective fluid passage, the first side being formed as a knife grain surface.

For example, the micro-fluid pump is a liquid pump and the pump body comprises a valve assembly which comprises a valve seat with a liquid discharge cavity formed thereon, the liquid discharge cavity is formed with a plurality of liquid discharge holes therein defining a portion of the liquid discharge passage; a discharge valve installed in the liquid discharge cavity and having a plurality of valve flaps which cover the plurality of liquid discharge holes. At least two protruding positioning posts are disposed in the liquid discharge cavity, and at least two receiving portions are disposed in the discharge valve, the receiving portions being configured to receive at least two positioning posts of the valve seat.

For example, the at least two positioning posts comprise a center positioning post disposed at a center of the liquid discharge cavity and a peripheral positioning post disposed between the two adjacent liquid discharge holes at a distance from the center of the liquid discharge cavity. Said discharge valve has a central connecting portion for connecting the plurality of valve flaps and at least one lug between two adjacent valve flaps, the central connecting portion is provided at its center thereof with a center receiving portion for receiving the center positioning post, and at least one of the lugs is provided with a peripheral receiving portion for receiving the peripheral positioning post.

For example, the central connecting portion comprises a plurality of lugs, each of which is located between each two adjacent valve flaps and is provided with a peripheral receiving portion for receiving the peripheral positioning post.

For example, the at least two positioning posts are all peripheral positioning posts, each of which is disposed between the two adjacent liquid discharge holes and at a distance from the center of the liquid discharge cavity. The discharge valve has a central connecting portion for connecting the plurality of valve flaps and at least two lugs, at least two of the lugs being provided with a peripheral receiving portion for receiving the peripheral positioning post.

For example, the receiving portion is formed as a through-hole or a receiving recess.

For example, the pump body comprises a valve seat which is provided with a plurality of through-hole groups, each of which comprises a liquid inlet hole for liquid inflow and a liquid discharge hole for discharging liquid; a diaphragm seat mounted with a diaphragm portion thereon, the diaphragm portion is regularly arranged with a plurality of diaphragm units with respect to a center thereof, and the diaphragm seat is provided with a plurality of mounting holes for accommodating the respective diaphragm units. Said valve seat is provided with positioning posts between each two adjacent through-hole groups, the positioning posts are able to pass through corresponding positioning holes on the diaphragm portion to fit into corresponding positioning recesses on the diaphragm seat.

For example, the pump body comprises a diaphragm seat mounted with a diaphragm portion, the diaphragm portion is regularly arranged with a plurality of diaphragm units with respect to a center thereof, which are reciprocally compressible and stretchable; a valve seat on which a plurality of compression zones are distributed, each of which corresponds to one of the plurality of diaphragm units and provided with a liquid inlet hole for the liquid inflow covered with an inlet valve, and a liquid discharge hole for discharging the liquid covered with a discharge valve. The compression zone is provided with a pressurizing boss and a notch region partially surrounded by the pressurizing boss, and the pressurizing boss protrudes from the base surface of the valve seat into the corresponding diaphragm unit and provided an inlet valve seat surface, which is higher than a bottom surface of the valve seat, for receiving the inlet valve thereon, the liquid inlet hole is provided in the inlet valve seat surface and penetrates the pressurizing boss, and the liquid discharge hole is opened in the notch region.

For example, the micro-fluid pump further comprises a motor for providing power for the operation of the micro-fluid pump. The pump body is mounted to the motor and includes a diaphragm assembly which comprises a diaphragm portion regularly arranged with a plurality of compressible diaphragm units around its center, each of the diaphragm units having a cavity with an opening, a compression body and a flexible cavity wall between the opening and the compression body, the cavity wall comprising a uniform thickness portion and a linear thickened portion adjacent to the opening; a diaphragm seat having a receiving side which is provided with a receiving recess for receiving the diaphragm portion, which receiving recess is provided with a plurality of mounting holes for accommodating cavity walls of the respective diaphragm units. The diaphragm assembly further comprises a diaphragm deformation control structure comprising the linear thickened portions of the cavity walls of the cavities of the diaphragm units; linear portions of inner side walls of the mounting holes which cooperate with the linear thickened portions, for controlling deformation of the upper portions of the cavity walls; and portions for avoiding expansion of the inner side walls of the mounting holes that cooperate with the uniform thickness portions. The uniform thickness portions of the cavity wall have a thickness of 0.5 mm, the linear thickened portions have a length in the longitudinal direction of 0.9 mm, and the linear portions of the inner side walls of the mounting holes have a length in the longitudinal direction of 0.85 mm.

According to an embodiment of the present disclosure, a one-way valve is provided, which is an umbrella valve having an umbrella face with a first side covering a corresponding fluid passage, the first side being formed as a knife grain surface.

For example, the knife grain surface has knife grains in the form of concentric circles or helices.

For example, the one-way valve has an umbrella stem which extends along an axis, the first side has an annular inclined face that is inclined away from the umbrella stem and has an angle of 1.20 to 1.60 degrees with respect to a plane perpendicular to the axis of the umbrella stem.

According to an embodiment of the present disclosure, a micro-fluid pump capable of controlling flow precisely is provided and comprises a motor for providing power for the operation of the micro-fluid pump; a pump body mounted to the motor and comprising a diaphragm assembly. The diaphragm assembly comprises a diaphragm portion regularly arranged with a plurality of compressible diaphragm units around its center, each of the diaphragm units having a cavity with an opening, a compression body, and a flexible cavity wall between the opening and the compression body, the cavity wall comprising a uniform thickness portion and a linear thickened portion adjacent to the opening; and a diaphragm seat having a receiving side which is provided with a receiving recess for receiving the diaphragm portion, which receiving recess is provided with a plurality of mounting holes for accommodating the cavity walls of the respective diaphragm unit. The diaphragm assembly further comprises a diaphragm deformation control structure including the linear thickened portions of the cavity walls of the cavities of the diaphragm units; linear portions of inner side walls of the mounting holes which cooperate with the linear thickened portions, for controlling deformation of the upper portions of the cavity walls; linear portions of inner side walls of the mounting holes which cooperate with the linear thickened portions, for controlling deformation of the upper portions of the cavity walls; and an portion for avoiding expansion of the inner side walls of the mounting holes that cooperates with the uniform thickness portions. The uniform thickness portions of the cavity wall have a thickness of 0.5 mm, the linear thickened portions have a length in the longitudinal direction of 0.9 mm, and the linear portion of the inner side wall of the mounting hole have a length in the longitudinal direction of 0.85 mm.

For example, the diaphragm units have a circular cross section; the linear thickened portion have an outer diameter of 10.1 mm, and a linear portions of the inner side walls of the mounting holes have an inner diameter of 10.2 mm, and/or the diaphragm portion has a diaphragm mounting that integrally connects the respective diaphragm units and is received in the receiving recess, the diaphragm mounting having a length of 1.2 mm in the longitudinal direction.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
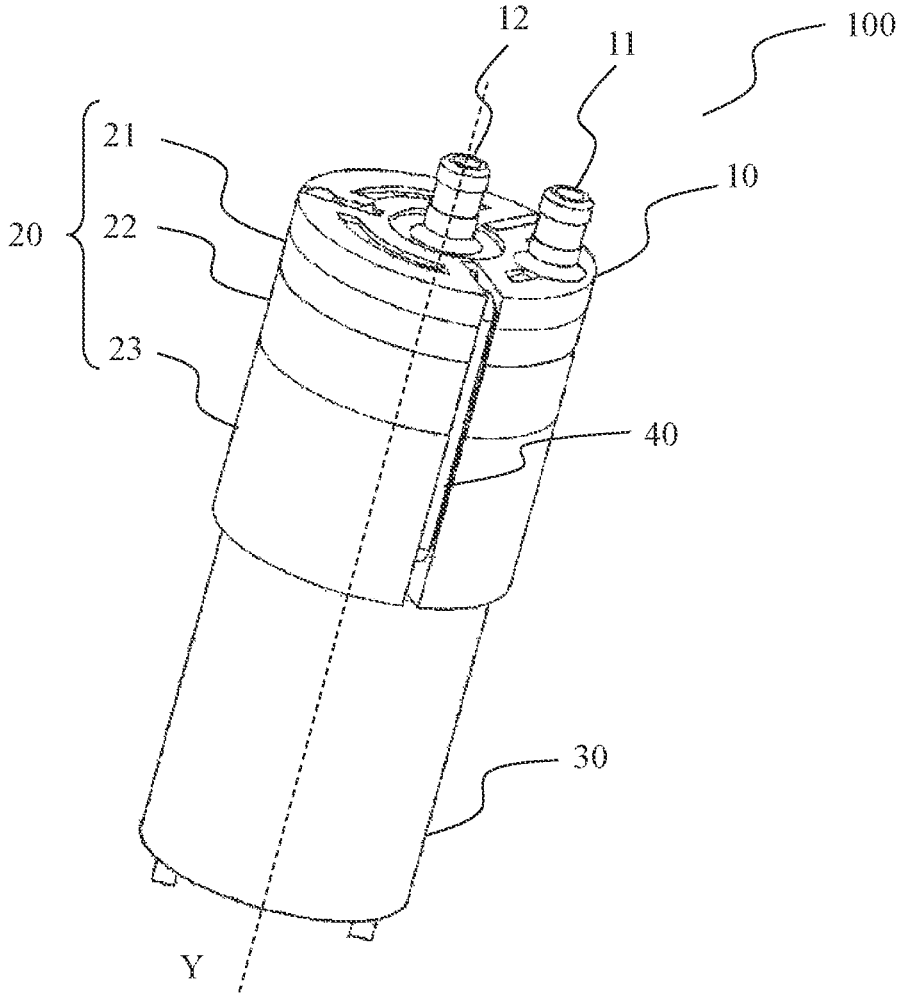
FIG. 1 shows an overview of an embodiment of a micro-fluid pump of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

The drawings are merely schematic and are not necessarily drawn according to a scale. The thickness and shape of each layer in the drawings do not reflect a true scale, and are only for the convenience of describing the contents of the present disclosure. The same reference numerals in the drawings denote the same or similar parts, and their repeated description will be omitted.

The orientation or positional relationship indicated by the terms "top side", "bottom side", "upper", "lower" and the like in the present disclosure is based on the orientation or positional relationship shown in the drawings, or the orientation or positional relationship conventionally placed when the public product is used, or the orientation or positional relationship conventionally understood by those skilled in the art. These terms are used merely for describing the present disclosure and simplifying the description, but not for indicating or implying that the devices or elements have to have particular orientations or be constructed and operated in particular orientations, and thus cannot be understood as a limit to the disclosure.

Figure 2A:
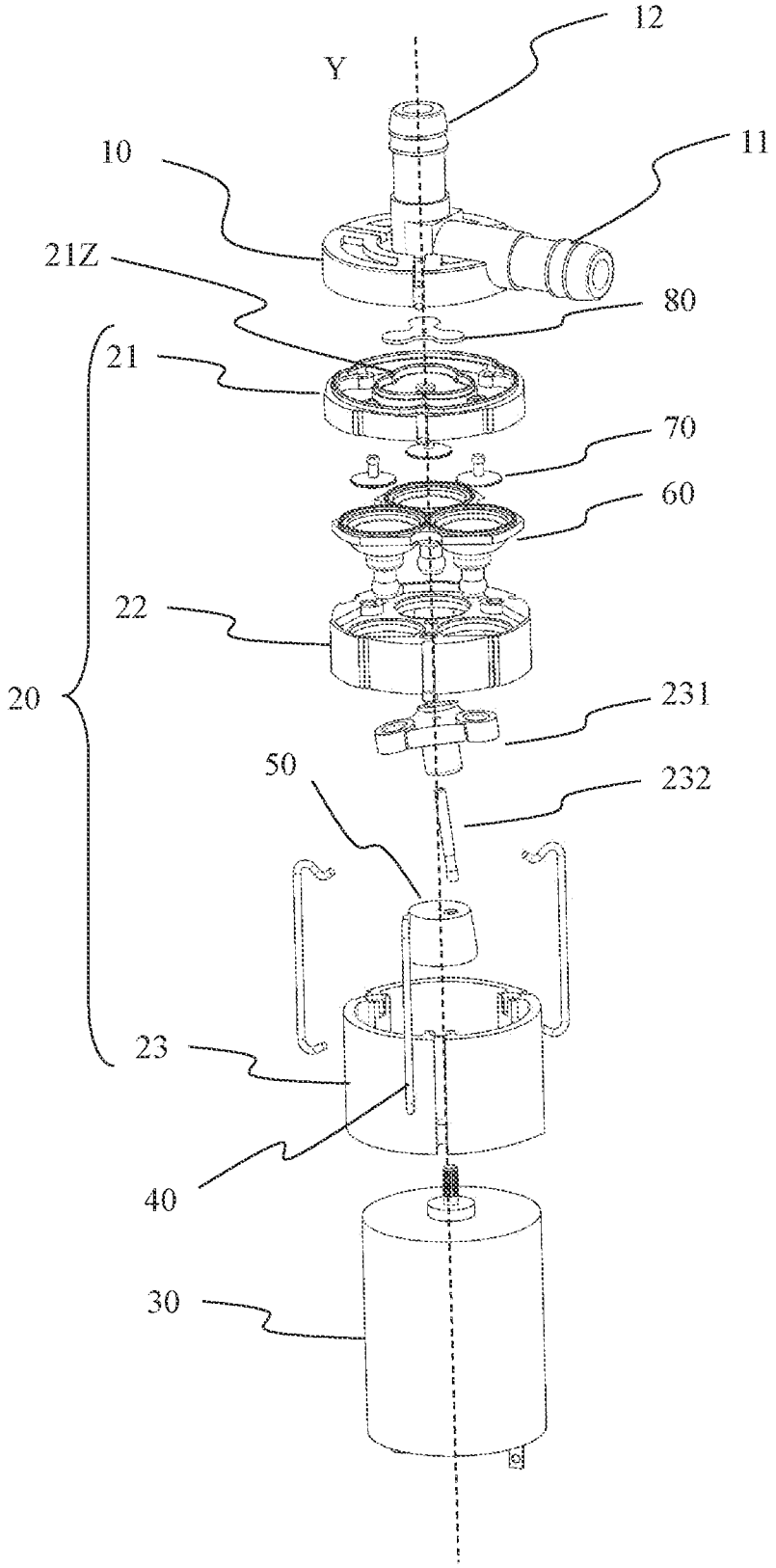
FIG. 2A-2C show exploded views of different embodiments of a micro-fluid pump in accordance with the present disclosure.
Figure 2B:
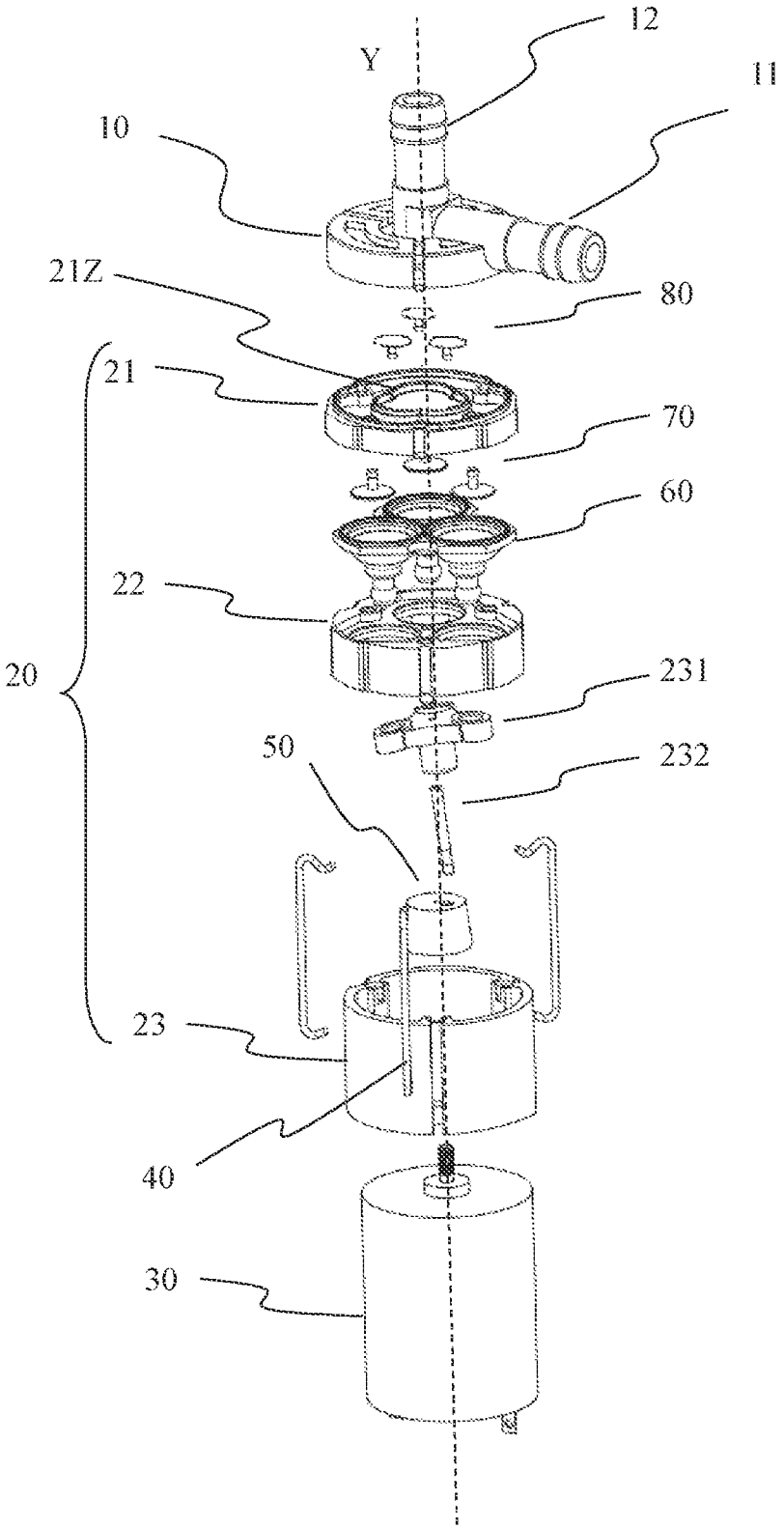
Figure 2C:
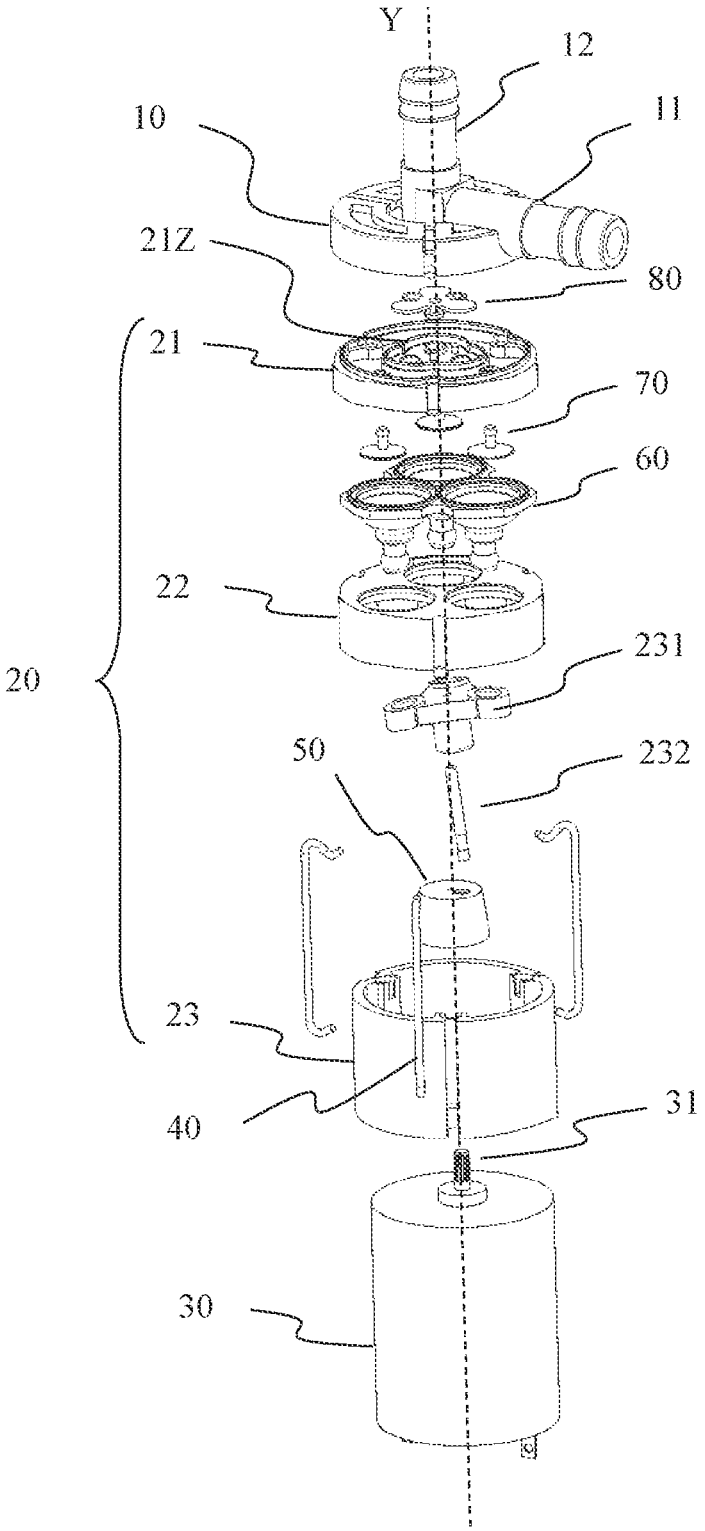

The embodiment of the present disclosure provide a micro-fluid pump, such as a diaphragm pump, which may be a water pump or a gas pump depending on its application. FIG. 1 shows an assembled micro-fluid pump 100. FIGS. 2A to 2C are exploded views of the fluid pumps 100 showing different embodiments thereof respectively. As shown in FIGS. 1 and 2, the fluid pump 100 may comprise a pump cover 10 which may be provided with an inlet 11 and an outlet 12. Fluid enters the interior of the fluid pump 100 through the inlet 11, is then pressurized inside the pump, and finally flows out of the fluid pump 11 through the outlet 12. The inlet 11 and the outlet 12 shown in FIG. 1 are arranged substantially in parallel along a longitudinal axis Y. It is shown in FIGS. 2A-2C that the inlet 11 is substantially in parallel to the longitudinal axis Y while the outlet 12 is disposed substantially perpendicular to the inlet 11. It will be appreciated that the relative arrangements of the inlet 11 and the outlet 12 of the pump cover 10 shown in FIGS. 1 and 2A-2C are not necessary, which are only two of the examples and can be provided according to the actual need for the product assembled which the pump.

Further as shown in figures, the fluid pump 100 may comprise a pump body 20 which may comprise a valve seat 21, a diaphragm seat 22 and a housing 23, with the pump cover 10 covering the pump body 20; and a motor 30 installed to a bottom of the pump body 20 for driving the fluid pump 100 to operate. The fluid pump 100 can have an inlet passage for fluid inflow and a discharge passage for discharging fluid, which can be established by respective portions on various components of the fluid pump 100, as will be described in detail below. In the orientation shown in the figures, the pump cover 10, the valve seat 21, the diaphragm seat 22 and the housing 23 are assembled together in this order from top to bottom, for example, by a snap spring 40.

Referring to FIGS. 2A-2C, the valve seat 21 of the pump body 20 may be provided with an outflow passage for discharging fluid thereon, and may further be provided with an inflow passage for introducing fluid, such as holes for inflow/outflow of fluid (not shown). The valve seat 21 can be fitted with an inlet valve 70 and a discharge valve 80 which respectively cover the inflow and outflow holes of the valve seat 21 in order to prevent the incoming fluid and the exiting fluid from flowing back. The discharge valves 80 shown in FIGS. 2A-2C take different forms and will be described in detail below.

The diaphragm seat 22 of the fluid pump 100 may be mounted with a diaphragm portion 60 which may constitute a diaphragm assembly of the pump body 20 with the diaphragm seat 22 and is arranged with a plurality of compressible diaphragm units regularly with respect to a center thereof. A triplet diaphragm portion 60 is illustrated in FIGS. 2A-2C. It should be understood that a diaphragm portion in the form of a duplet, quadruplet or the like can be provided depending on the needs of the different applications.

Additionally, the pump body may comprise a transmission mechanism housed in the housing 23 and configured to convert rotational motion of the output shaft 31 of the motor 30 into a reciprocating compression motion of the diaphragm portion 60 along the longitudinal axis Y. The transmission mechanism may comprise a crank 231 sleeved at heels of the diaphragm units, a rotational wheel 50 driven by the motor 30, and a swing shaft 232 between the crank 231 and the rotational wheel 50. One end of the swing shaft 232 is inserted into a bottom recess of the crank 231 and the other end is eccentrically inserted into the corresponding hole of the rotational wheel 50.

Figure 3A:
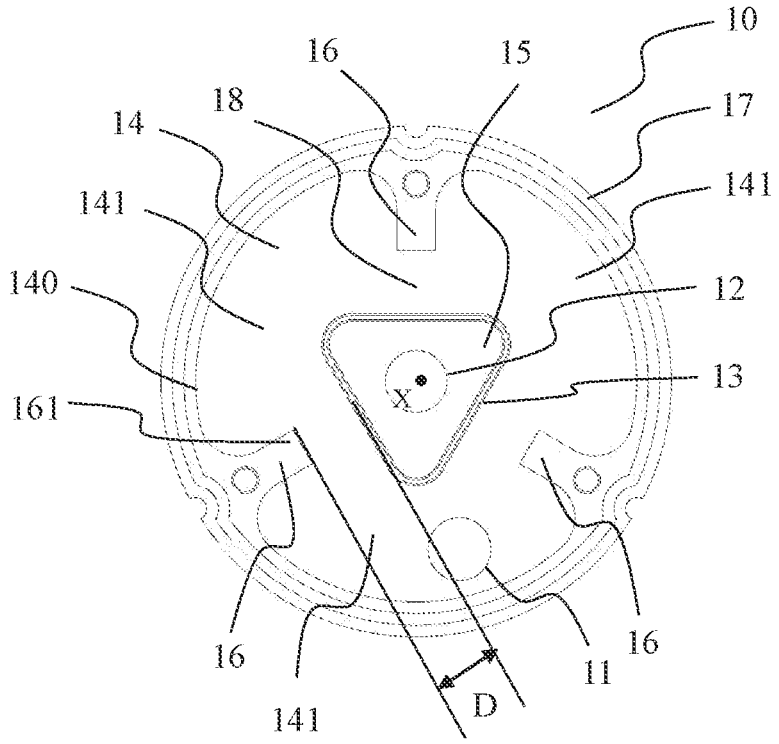
FIG. 3A-3B show bottom views of different embodiments of a pump cover of a micro-fluid pump according to the present disclosure.

Now the pump cover of the fluid pump 100 will now be described with reference to FIGS. 3A, 3B and 4. FIG. 3A shows a bottom side of an embodiment of the pump cover 10 of the fluid pump 100, i.e., the side facing the valve seat 21. The pump cover 10 may include an inlet cavity 14 for containing fluid entering the fluid pump 100 from the outside and a discharge cavity 15 for containing fluid to be discharged from the fluid pump, the inlet cavity 14 and the discharge cavity 15 being separated by a partition portion 13. That is, the inlet cavity 14 is not in fluid communication with the discharge cavity 15. The partition portion 13 may have the form of a wall which protrudes from a bottom face of the pump cover 10. In the example shown in FIG. 3A, the inlet cavity 14 is disposed around the discharge cavity 15, and the partition portion 13 is located at the center of the bottom face of the pump cover 10 and shaped as a closed loop. A triangular closed-loop partition portion 13 is shown in FIG. 3A, but other shapes are also possible as needed.

The pump cover 10 can also include at least one distribution wall 16 on its bottom face, which protrudes, for example, from the bottom face of the pump cover 10. Although three distribution walls 16 are shown in FIG. 3A, the present disclosure is not limited to three distribution walls 16, the number of which may be set according to actual needs. The distribution wall 16 may be provided in the inlet cavity 14 for distributing and guiding the fluid flowing into the inlet cavity 14 through the inlet 11. In particular, the distribution wall 16 may extend partially towards the partition portion 13. The expression "partially" means that the distribution wall 16 extends towards the partition portion 13 but does not reach the partition portion 13.

The inlet cavity 14 also has an inlet cavity outer wall 140 which extends for example along a peripheral wall 17 of the pump cover 10. As shown in FIG. 3A, the distribution wall 16 may extend from the inlet cavity outer wall 140 toward the partition portion 13, for example radially. The distribution wall 16 may extend inwardly from the inlet cavity outer wall 140 to a distance D from the partition portion 13, which distance D can be, for example, one-third, one-half, two-thirds, etc. of the radial distance from the inlet cavity outer wall 140 to the partition portion 13.

In a preferred example, the distribution walls 16 can be spaced at a regular angle with respect to the center X of the pump cover 10, for example, 120° as shown, thereby dividing the inlet cavity 14 into a plurality of inlet sub-cavities 141. With the distribution wall 16 partially extending toward the partition portion 13, a hollow passage 18 may be formed between an inner end 161 of the distribution wall 16 and the partition portion 13, and when flowing into the inlet cavity 14 from the inlet 11, the fluid passes through the hollow passage 18 and is then distributed into all of the inlet sub-cavities 141 under the guidance of the distribution wall 16.

When the pump cover 10 is assembled with the valve seat 21, a space can be defined between the bottom face of the pump cover and a top face of the valve seat, which is called a distribution space (not shown). The distribution space has a height, that is, a length along the longitudinal axis Y (FIGS. 1 and 2). When the distribution wall 16 extends partially, its height protruding from the bottom of the pump cover 10 may be equal to or less than the height of the distribution space. When the height of the distribution wall 16 is equal to that of the distribution space, the fluid flows into the inlet sub-cavities 141 only through the hollow passage 18. When the height of the distribution wall 16 is less than that of the distribution space, the fluid flows into the inlet sub-cavities 141 not only through the hollow passage 18 but also across the side of the distribution wall 16 facing the valve seat 21. The height and extension length of the distribution wall 16 can be adjusted according to the requirements for the flow rate, the uniformity of the distribution, the volume of the fluid and the like of the incoming fluid, to optimize the overall performance of the fluid pump 100.

Figure 3B:
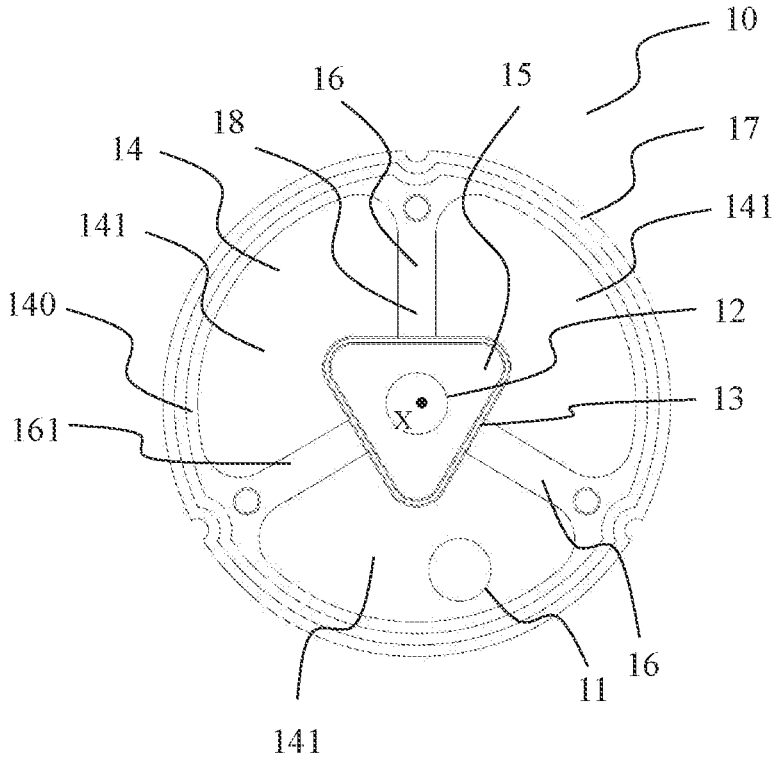

FIG. 3B shows another embodiment of the pump cover 10 which differs from the pump cover 10 shown in FIG. 3A in that the distribution wall 16 may extend from the inlet cavity outer wall 140 to the partition portion 13, that is to say without the hollow passage 18 described above. Here, the height of the distribution wall 16 is less than that of the distribution space, and the fluid can flow into the inlet sub-cavities 141 across the side of the distribution wall 16 facing the valve seat 21. The height of the distribution wall 16 can be adjusted to optimize the overall performance of the fluid pump 100.

In the present disclosure, the distribution wall not only functions to distribute and guide the incoming fluid, but also significantly increases the structural strength of the pump cover. As previously mentioned, the deformation of the pump cover due to vibration may cause a risk of fluid leakage, which is a problem that should be overcome for fluid pumps that achieve good stability. The distribution wall of the pump cover in the present disclosure extends in the inlet cavity, which can both effectively reduce the impact force of the incoming fluid and obtain an optimized fluid flow rate and volume, and at the same time provide a higher torsional strength for the pump cover, so that the entire pump cover is kept flat. The anti-deformation effect is optimal when a plurality of distribution walls extend to the partition portion. In addition, the distribution walls are distributed at a regular angle around the center of the pump cover, which makes the pump cover more evenly stressed. When the distribution wall extends to the partition portion, the structural reinforcement of the distribution wall 16 can be combined with the structural reinforcement of the partition portion 13, which improves not only the strength of the peripheral area of the pump cover, but also the strength of the central area of the pump cover with discharge cavity, so that the overall structural strength of the pump cover is significantly improved.

Figure 4:
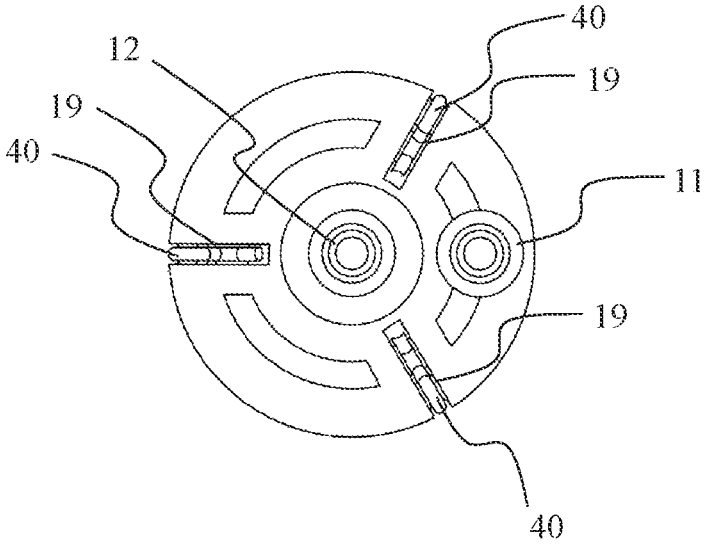
FIG. 4 shows a top view of an embodiment of a pump cover of a micro-fluid pump according to the present disclosure.

Referring now to FIGS. 2A-2C showing an exploded view of fluid pump 100, exemplified by a diaphragm pump, in conjunction with FIGS. 3A-4, the specific construction of the pump cover will be further described. The inlet 11 and the inlet cavity 14 of the pump cover 10 and the inflow hole (not shown) of the valve seat 21 together constitute an inlet passage of the fluid pump 100, the outflow hole of the valve seat 21 and the discharge cavity 15 and the outlet 12 of the pump cover 10 together constitute a discharge passage of the fluid pump 100. The pump cover 10 may cover on the valve seat 21 and the inlet valves 70 may correspond to the inlet sub-cavities 141 of the pump cover 10, i.e., the inlet valves 70 and the inlet sub-cavities 141 are in one-to-one correspondence at positions along the longitudinal axis Y after assembly. At this point, the distribution wall 16 of the pump cover 10 may be located between two adjacent inlet valves 70. Thereby, a more precise fluid distribution requirement, a more evenly distributed structural force, reduced vibration and thus less noise are achieved.

Figure 5:
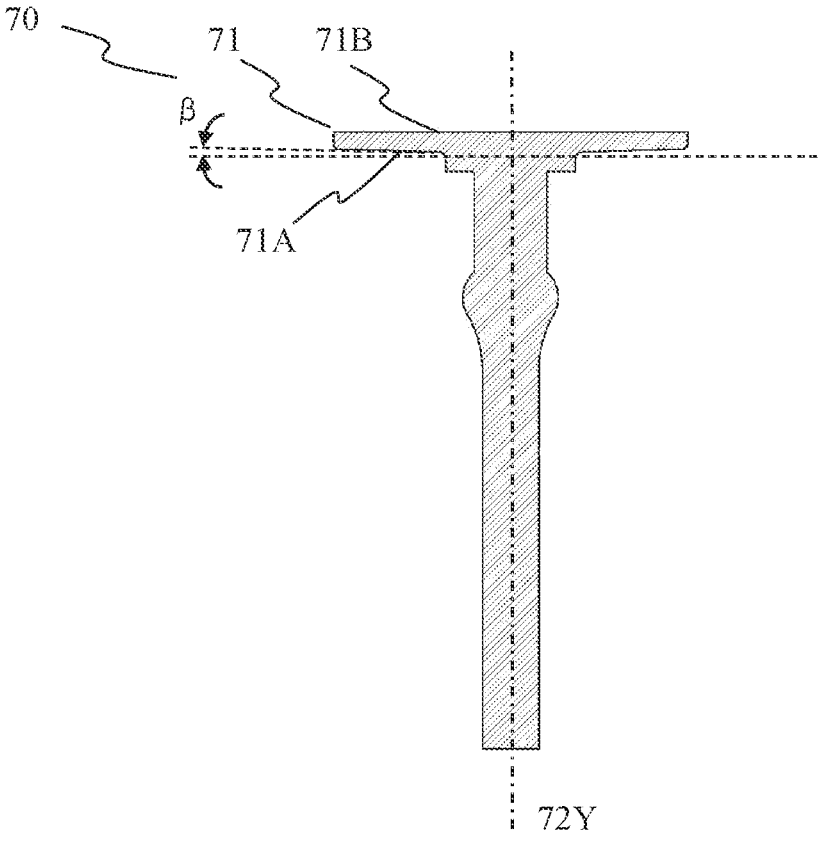
FIG. 5 shows an axial cross-sectional view of a one-way valve according to the present disclosure.

A top side of the pump cover 10 will now be described with reference to FIG. 5. As shown, the top side of the pump cover 10 may be provided with a recess 19 for snapping the snap spring 40 therein. In particular, the position of the recess 19 corresponds to the position of the distribution wall 16 on the bottom side, that is to say, a recess 19 on the top side forms a projecting distribution wall 16 on the bottom side by depression. Thus, the distribution wall 16 in accordance with the present disclosure also provides a clamping position for the snap spring 40, i.e., the distribution wall 16 may simultaneously provide multiple functions: distributing and guiding fluid, enhancing the structural strength of the pump cover, and offering clamping position for the assembly of snap spring.

As described above, the valve seat 21 of the pump body 20 may be provided with holes (not shown) for fluid inflow/outflow. A one-way inlet valve 70 covering the inflow hole may be located between the valve seat 21 and the diaphragm seat 22. A one-way discharge valve 80 covering the outflow hole may be located between the valve seat 21 and the pump cover 10.

In one embodiment, as shown in FIG. 2B, the one-way valves 70, 80 may all be umbrella valves, that is, each or each set of inflow or outflow holes is covered by an umbrella valve. Referring specifically to FIG. 5, an example of a one-way inlet valve 70 is shown. The one-way discharge valve 80 may have a similar structure to the one-way inlet valve 70 and will not be described again. The one-way inlet valve 70 in the form of an umbrella valve has a umbrella face 71 that can have the form of a generally circular disk with a diameter of approximately 6.3 mm; and an umbrella stem 72 that can extend from the center of the umbrella face 71 along an axis 72Y. The umbrella stem 72 can pass through a corresponding mounting hole (not shown) on the valve seat in order to mount the one-way inlet valve 70. The axis 72Y may be parallel to the longitudinal axis Y of the fluid pump 100. FIG. 5 shows an axial cross-sectional view of the one-way inlet valve 70.

The umbrella face 71 may have a first side 71A covering the inflow passage of the valve seat 21 and a second side 71B opposite to the first side 71A. The second side 71B can have a planar form whereby the umbrella face 71 can be in the form of a flat disk with a thickness (i.e., a length along the axis Y) of approximately 0.35 mm. The flat umbrella face has the advantage of being opened easily and space saving, enabling the components to be cooperated with it to have a smaller size.

Figure 6:
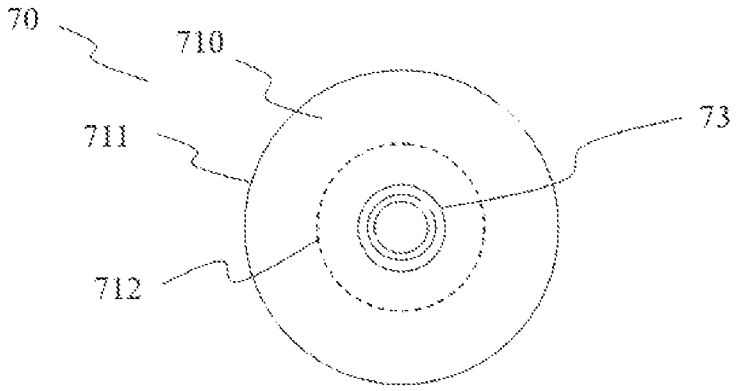
FIG. 6 shows a view of the one-way valve according to the present disclosure as seen from the direction of the umbrella stem.

The first side 71A of the umbrella face 71 may have an annular inclined face 710 which can occupy a portion or entire of the first side 71A. FIG. 6 shows a schematic view of the one-way valve as seen from the free end of the umbrella stem of FIG. 5. In FIG. 6, the portion between the outer peripheral edge of the umbrella face 71 and the dashed circle 712 defines an annular inclined face 710. Thus, in this example, the annular inclined face 710 occupies a portion of the first side 71A. As also shown in FIG. 5, the annular inclined face 710 can be inclined away from the umbrella stem 72. "Away from" means that the angle between the annular inclined face 710 and the axis 72Y of the umbrella stem 72 is greater than 90 degrees. The angle β of the annular inclined face 710 with respect to the plane P perpendicular to the axis 72Y of the umbrella stem 72 is in the range of 1.20 to 1.60 degrees. Since the fluid (especially water) carries impurities and foreign matter, these impurities and foreign matter are easily deposited on the side of the umbrella valve covering the fluid passage, i.e. between this side of the umbrella valve and the valve seat, which upwarps the umbrella face and may prevent the umbrella valve from sealing the fluid passage. The provision of the inclined face on this side can avoid the impurities carried by the fluid from depositing on the umbrella valve when the fluid passes through the umbrella valve, and take away some foreign matter that may have been deposited before, thereby improving the self-cleaning ability of the umbrella valve. Moreover, due to the setting of the inclination angle, the sealing property of the one-way valve is not lowered while the umbrella face 71 is more easily opened. In the preferred case, the angle β of the annular inclined face 710 with respect to the plane P perpendicular to the axis 72Y of the umbrella stem 72 is 1.30 to 1.50 degrees. More preferably, for example, this angle β is 1.43 degrees.

Further, the first side 71A of the umbrella face 71 of the one-way valve 70 may be formed as a knife grain surface. The knife grain surface are to be understood as follows: after machining (for example by a turning tool or a milling cutter), knife grain is formed on the surface of the mold, without polishing or grinding, and the one-way valve 70 is injection molded by rubber, and the first side 71A thereof corresponds to the said surface of the mold and thus is formed as a knife grain surface. When the side of the valve covering the fluid passage is a smooth surface, this side will contact the valve seat over a large area, thereby forming a suction phenomenon, which causes a difficulty of opening of the umbrella face and hinder the passage of the fluid. The side covering the fluid passage being formed as a knife grain surface, due to the surface texture of the knife grain surface, can avoid the above suction phenomenon and improve the response sensitivity of the one-way valve to achieve a precise opening and closing. The knife grains of the knife grain surface may be in the form of concentric circles or helical lines to form a layer-by-layer seal for better sealing performance. It should be noted that the first side 71A of the umbrella face 71 is formed such that the knife grain surface can be independently of the annular inclined face 710 which the first side 71A has. That is to say, the he first side 71A may be formed as a knife grain surface regardless of whether it has an annular inclined face 710.

Figure 7:
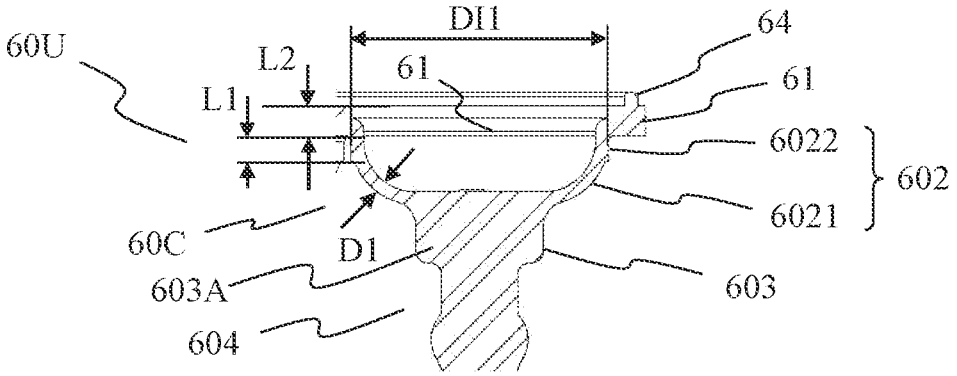
FIG. 7 shows a longitudinal cross-sectional view of one diaphragm unit of a diaphragm portion according to the present disclosure, through which longitudinal cross-sectional view a longitudinal axis of the diaphragm unit passes.

Then, the above diaphragm assembly will be specifically described with reference to FIGS. 7 and 8. As described above and as shown in FIGS. 2A-2C, the diaphragm assembly may comprise a diaphragm portion 60 having a plurality of diaphragm units 60U and a diaphragm seat 22. One of the diaphragm units 60U is shown in FIG. 7, and other diaphragm units not shown are similar thereto and will not be described again. Each diaphragm unit 60U may have a cavity 60C which may have an opening 601, a compression body 603 and a flexible cavity wall 602 between the opening 601 and the compression body 603. The cavity 60C may have a generally bowl shape or an inverted bell shape.

The diaphragm unit 60U may further comprise an installation column 604 that extends from the compression body 603 toward the diaphragm seat 22. After the fluid pump 100 is assembled, the installation column 604 passes through the sleeve hole 2311 of the crank 231 to cooperate with the crank 231 for allowing the crank 231 to drive the reciprocating motion of the compressible diaphragm unit 60U through its sleeve hole 2311 when the fluid pump 100 is in operation.

Further, at least a portion of the side of the extruded body that contacts the crank 231 is formed as a plane 603A, specifically an annular plane. The annular plane 603A can ensure an increased contact area between the crank 231 and the compression body 603, improving the stability of the motion.

The cavity wall 602 may comprise a uniform thickness portion 6021 and a linear thickened portion 6022 adjacent the opening 601. The uniform thickness portion 6021 is located between the linear thickened portion 6022 and the compression body 603 and has a thickness of approximately 0.5 mm. The thickness of the uniform thickness portion 6021 is an important factor in ensuring the precise flow rate of the fluid pump 100. If the thickness is too thin, the cavity 60C will expand very much, and the flow rate of the discharged fluid will be large, which is contrary to the goal of precisely controlling the flow rate of the micro-fluid pump. In the present disclosure, the thickness D1 of 0.5 mm of the uniform thickness portion 6021 of the cavity wall 602 can suppress the expansion of the cavity 60C, ensure the compression ratio of each working cycle is consistent, and contribute to the fluid pump 100 delivering fluid at a precise and consistent flow rate.

Additionally, the linear thickened portion 6022 is connected to the uniform thickness portion 6021 and is close to the opening 601. The linear thickened portion 6022 has the meaning that its radially outer side surface extends in a straight line, that is, the linear thickened portion 6022 forms an annular body which has an outer side surface extending in a straight line, for example, extending a length L1 along the longitudinal axis Y of substantially 0.9 mm, and has a thickness greater than that of the uniform thickness portion 6021. The diaphragm unit 60U may thus have a circular cross section, and its linear thickened portion may have an outer diameter DI1 of approximately 10.1 mm. The provision of a linear thickened portion near the opening 601 also facilitates to control the degree of expansion of the cavity 60C.

Figure 8:
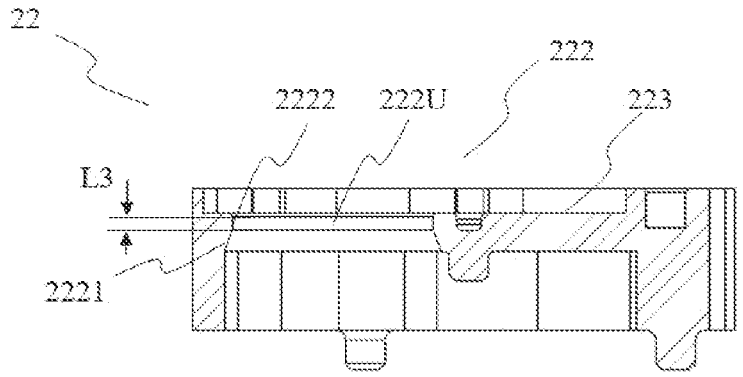
FIG. 8 shows a longitudinal cross-sectional view of a diaphragm seat according to the present disclosure.

Referring now to FIG. 8, a longitudinal section of the diaphragm seat 22 is shown. As shown in FIG. 8, the diaphragm seat 22 may have a receiving side 222 on which is provided with a receiving recess 223 for receiving the diaphragm portion 60, which receiving recess 223 is provided with a plurality of mounting holes 222U for receiving the cavity walls of the respective diaphragm unit.

In the present disclosure, the diaphragm assembly may further comprise a diaphragm deformation control structure for controlling deformation of the diaphragm unit during repeated compression of the flexible cavity wall of the diaphragm portion when the diaphragm portion is assembled on the diaphragm seat. Specifically, the diaphragm deformation control structure may comprise a linear thickened portion 6022 of the cavity wall 602, a linear portion 2222 and a portion for avoiding expansion 2221 of an inner side wall of the above mounting hole 222U of the diaphragm seat 22. The linear portion 2222 cooperates with the linear thickened portion 6022 of the cavity wall 602 for controlling the deformation of the upper portion of the cavity wall 602, and may have an inner diameter of approximately 10.2 mm. For example, during the operation of the fluid pump 100, the diaphragm unit 60U is operated under pressure, the cavity is squeezed, and the cavity wall 602 is easily expanded radially and outwardly, causing mutual interference between various diaphragm units or outside of the cavity wall 602 in contact with the other components thereby affecting the normal movement of the diaphragm portion. In the present disclosure, the linear portion 2222 of the inner side wall of the mounting hole 222U cooperate with the linear thickened portion 6022 of the cavity wall 602 of the diaphragm unit 60U, and may have a length L3 in the longitudinal direction Y of 0.85 mm, which constrains the radially outward expansion of the upper portion of the cavity wall 602, ensuring that the interference of the upper portion of the cavity wall 602 with other components is completely avoided.

The portion for avoiding expansion 2221 may be connected to the linear portion 2222, may extend away from the receiving side 222 along the longitudinal axis Y and may be radially flared as shown in FIG. 8. The portion for avoiding expansion 2221 corresponds to and cooperates with the uniform thickness portion 6021 of the cavity wall 602. Specifically, during operation of the fluid pump 100, in the case where the linear thickened portion 6022 of the cavity wall 602 cooperates with the linear portion 2222 of the mounting hole to control the deformation of the upper portion of the cavity wall, the uniform thickness portion 6021 of the cavity wall 602 may still generate a radially outward expansion to a large degree. The portion for avoiding expansion 2221 of the inner side wall of the mounting hole is inclined outwardly with respect to the longitudinal axis such that the maximum degree of expansion of the uniform thickness portion 6021 is that the outer side thereof contacts the portion for avoiding expansion 2221. The portion for avoiding expansion 2221 aims to block the cavity wall 602 as it expands, avoiding mutual scratching of the outside of the cavity walls 602 of the adjacent diaphragm units 60U.

In addition, a circular arc transition is formed between the compression body 63 and the uniform thickness portion 6021 of the cavity wall 602. Such an arrangement may ensure the increase of an effective area of the body of the diaphragm unit during operation, thereby ensuring a stable compression ratio and outputting the fluid at a precise flow rate.

With continued reference to FIG. 7, the diaphragm portion may have a diaphragm mounting 61 that integrally connects the respective diaphragm units 60U and is received in the receiving recess 223 of the diaphragm seat 22. The diaphragm mounting has a length L2 in the longitudinal direction of 1.2 mm. The diaphragm portion 60 may further comprise a plurality of seal portions 64 provided on the diaphragm mounting 61, each of which surrounds the respective diaphragm unit 60U and protrudes longitudinally from the diaphragm mounting 61. The seal portion has a length in the longitudinal direction of 0.5 mm. After the fluid pump 100 is assembled, the valve seat 21 is pressed against the diaphragm seat 22, and the diaphragm mounting 61 with the sealing portion 64 together cooperate with the diaphragm seat 22 to ensure sufficient sealing capability, and this may not cause an over rubber reaction force due to over-pressing which results in a rebound gap between diaphragm seat 22 and valve seat 21.

Figure 9:
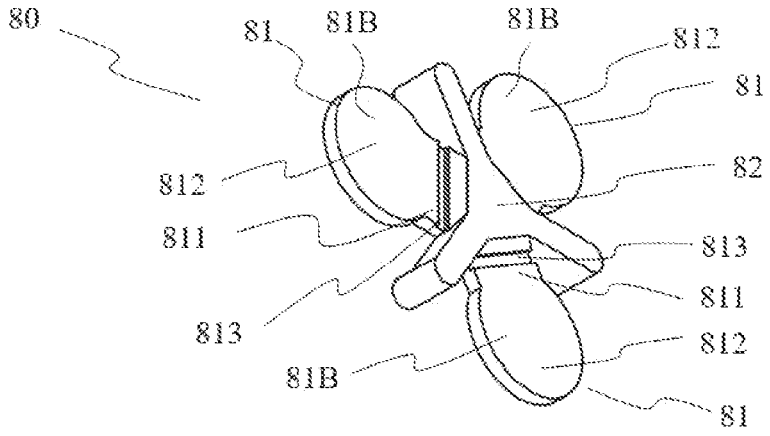
FIG. 9 shows a perspective view of a discharge valve of a micro-fluid pump according to the present disclosure.
Figure 10:
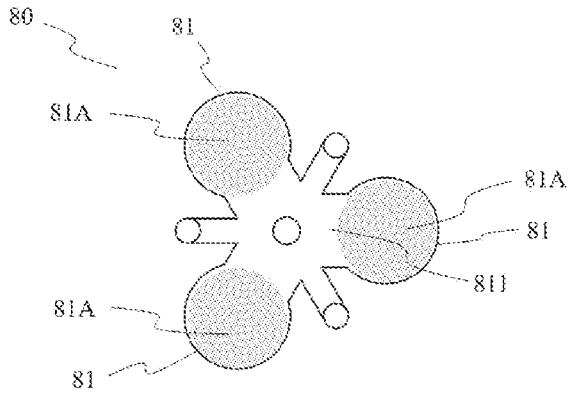
FIG. 10 schematically shows the view of a side of the discharge valve in FIG. 9 covering the valve seat.

In the above description, an embodiment of the discharge valve 80 (FIG. 2B) is described in which the discharge valve comprises a plurality of umbrella valves, each of which is used for a discharge passage on the valve seat 21. Another one-way discharge valve 80 will be specifically described below with reference to FIGS. 9 and 10 in conjunction with FIGS. 2A and 2C, which may have flexible valve flap 81 which covers the outflow passage of the valve seat 21 and seals the same to prevent backflow of fluid discharged through the outflow passage. After assembly, the side of the valve flap 81 facing the valve seat 21 is referred to as a first surface 81A and the side of the valve flap 81 facing the pump cover 21 is referred to as a second surface 81B which is opposite to the first surface 81A.

In the present disclosure, the first surface 81A of the valve flap 81 may be formed as a spark surface. The spark surface should be understood as follows: the surface of the mold is formed by electrical sparking machining, which has an unpolished or un-grinded spark surface with a surface texture formed by electrical spark left, and the flexible valve flap 81 is injection-molded by rubber with its first surface 81A corresponding to the mold surface on which the above surface texture is formed, thereby forming a spark surface.

FIG. 12 schematically shows the first surface 81A of the valve flap 81 of the discharge valve 80 formed as a spark surface. When the fluid is discharged, the fluid first passes through the outflow passage of the valve seat 21, contacts the first surface 81A of the valve flap 81 to open the valve flap 81, enters the space between the valve seat 21 and the pump cover 10 and then is discharged through the outlet 12. When the first surface 81A of the valve flap 81 covering the outflow passage of the valve seat 21 is a smooth surface, it tends to cause the valve flap 81 to adhere to the valve seat 21 (especially in the case of a water pump) and therefore the fluid cannot smoothly open the valve plate, which hinders the discharge, thereby affecting performance parameters such as the flow rate of the discharged fluid. In the present disclosure, since the first surface 81A of the valve flap 81 is formed as a spark surface, it is less likely to be adhered and can be smoothly opened by the fluid, thereby avoiding the above drawbacks.

With continued reference to FIGS. 11 and 12, the discharge valve 80 may have a valve flap set including a plurality of valve flaps 81, that is, the plurality of valve flaps 81 constitute a group. The present disclosure shows a discharge valve 80 having three valve flaps 81, but the discharge valve can have other numbers of valve flaps, for example, two, four, and the like. Each of the valve flaps 81 of the valve flap group may have a root 811 and a leaf 812. The discharge valve 80 can also have a central connecting body 82. The roots 811 of the valve flaps 81 can be connected to the central connecting portion 82 while the leaves 812 extend away from the central connecting body 82 from the roots 811. In the example shown in FIGS. 3 to 5, the leaves 812 of the valve flaps 81 extend radially outwardly and are evenly distributed around the central connecting body. The leaves 812 of these valve flaps 81 are spaced apart by hollow space. Thereby, each of the valve flaps 81 can be opened and closed independently.

The root 811 of the valve flap 81 can have a groove 813 which may extend transverse to the direction in which the leaf 812 extends. For example, the leaf 812 can extend in a radial direction and the groove 813 can extend in a direction perpendicular to the radial direction. The arrangement of the grooves 813 makes the valve flap 81 more flexible when bent, thereby facilitating the opening and closing of the valve flap 81.

Alternatively, the discharge valve 80 may take the form of a diaphragm set having other configurations. Other embodiments of the discharge valve 80 and its positioning arrangement on the valve seat 21 will now be described with reference to FIG. 2C and in conjunction with FIGS. 11A-11D, taking a liquid pump as an example.

FIGS. 11A-11D illustrate sides of an embodiment of the valve seat 21 of the fluid pump 100 that faces the pump cover. The valve seat 21 may include a liquid inlet cavity 211 for accommodating liquid from the pump cover side and a liquid discharge cavity 212 for allowing liquid to be discharged toward the pump cover side, and the liquid inlet cavity 211 and the liquid discharge cavity 212 may be separated by the partition portion 213, that is, the liquid inlet cavity 211 and liquid discharge cavity 212 are not in fluid communication, which partition portion 213 may have a form of a wall that protrudes from a top side surface (i.e., a surface facing the pump cover 10) of the valve seat 21. In the example shown in FIGS. 11A-11D, the liquid inlet cavity 211 is disposed around the liquid discharge cavity 212, and the partition wall 213 is located at the center of the top side surface of the valve seat 21 and is shaped as a closed loop.

A plurality of liquid discharge holes are formed in the liquid discharge cavity 212, and the plurality of liquid discharge holes may be evenly distributed with respect to the center of the liquid discharge cavity 212. The figure shows a valve seat with three liquid discharge holes 214*a*, 214*b*, 214*c*. It should be understood that other numbers of liquid discharge holes may be provided on the valve seat depending on the needs of different applications, for example, two, four, etc. The liquid discharge hole defines an outflow passage for discharging the liquid, that is, the liquid can pass from the bottom side of the valve seat, through the liquid discharge hole and into the liquid discharge cavity 212.

At least two positioning posts are disposed in the liquid discharge cavity of the valve seat 21, which positioning posts are configured to protrude from the top side surface of the valve seat toward the pump cover 10. In one embodiment, the positioning posts comprise a center positioning post 215 disposed at a geometric center O of the liquid discharge cavity 212. The positioning posts further comprise a peripheral positioning post disposed between the two adjacent liquid discharge holes at a distance from the center O of the liquid discharge cavity.

A scenario of one peripheral positioning post 216 is shown in FIG. 13A, which is disposed between the liquid discharge holes 214*a* and 214*b* and is offset from the center O of the liquid discharge cavity 212. Preferably, the line OA (indicated by a broken line in the drawing) connecting the liquid discharge hole 214*a* and the center O and the line OB (indicated by a broken line in the drawing) connecting the liquid discharge hole 214*b* and the center O form an angle AOB, and the peripheral positioning post 216 is positioned on the angle bisector OG of the angle AOB. Preferably, the peripheral positioning post 216 is located on or outside a circumference of a circle defined by the center of the liquid discharge holes 214*a*, 214*b*, and 214*c*. Thereby, the anchor points of the discharge valve 80 on the valve seat can be distributed over a large range so as to further improve the overall strength of the positioning structure.

It is also feasible to provide a plurality of peripheral positioning posts according to actual needs. FIG. 13B shows the case of three peripheral positioning posts, in this example, three peripheral positioning posts 216*a*, 216*b*, 216*c* are respectively disposed between each two of the three liquid discharge holes 214*a*, 214*b*, 214*c* and all of them are offset from the center O of the liquid discharge cavity 212 by a distance. Preferably, the line OA (indicated by a broken line in the drawing) connecting the liquid discharge hole 214*a* and the center O and the line OB (indicated by a broken line in the figure) connecting the liquid discharge hole 214*b* and the center O form an angle AOB, and the peripheral positioning post 216*a* is positioned on the angle bisector OG (indicated by a broken line in the figure) of the angle AOB. Similarly to the peripheral positioning post 216*a*, the peripheral positioning posts 216*b*, 216*c* are also located on the bisectors of the angles formed by the lines connecting the centers of the two adjacent liquid discharge holes and the center of the liquid discharge cavity. As shown, the three peripheral positioning posts 216*a*, 216*b*, 216*c* are evenly spaced at equal angles (120°) with respect to the center O of the liquid discharge cavity 212, and the liquid discharge cavity 212 forms a centrally symmetrical structure.

Figure 11A:
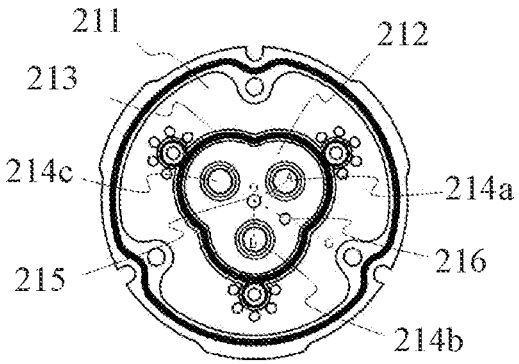
FIG. 11A-11D shows a view of the valve seat of the fluid pump according to the present disclosure as seen from the pump cover side.
Figure 11B:
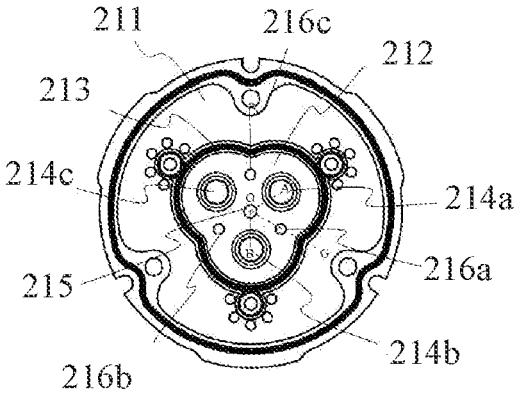
Figure 11C:
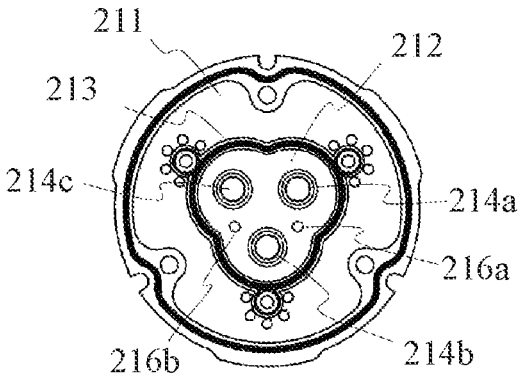
Figure 11D:
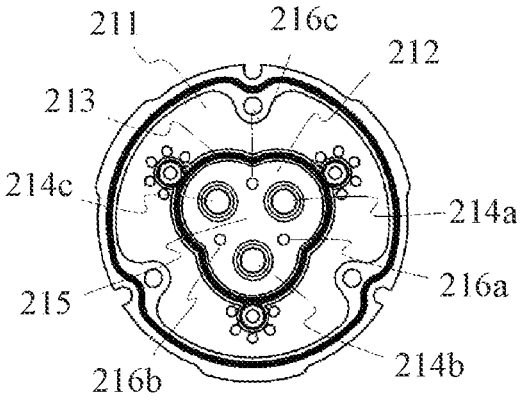

Two variants of the positioning post are shown in FIGS. 11C and 11D. Here, only the technical details specific to the variants are described and other identical technical details are omitted. As shown in FIG. 11C and FIG. 11D, no center positioning post is disposed at the center of the liquid discharge cavity 212 and the at least two positioning posts are both peripheral positioning posts that are offset from the center. The situation of two peripheral positioning posts 216*a*, 216*b* is illustrated in FIG. 11C and the situation of three peripheral positioning posts 216*a*, 216*b* and 216*c* is illustrated in FIG. 11D.

The structure of the discharge valve 80 will be described below with reference to FIGS. 12A and 12B. The discharge valve 80 may have a plurality of valve flaps 81, the number of which may be three as shown in figure, or two, four or the like. Each of the valve flaps 81 is joined together by a central connecting portion 82 and evenly distributed around the same.

Corresponding to the positions of at least two positioning posts on the valve seat 21, at least two positioning holes for receiving the positioning posts may be provided in the discharge valve 80. As shown in FIGS. 12A and 12B, the center of the central connecting portion 82 of the discharge valve 80 may be provided with a center positioning hole 821 for receiving the center positioning post 215 protruding from the valve seat 21. The discharge valve 80 can also have at least one lug 822 located between two adjacent valve flaps 81. The arrangement of the lug between the two adjacent valve flaps ensures that the individual valve flaps are independently bent and opened without mutual interference. A peripheral positioning hole 823 may be disposed in the lug 822 for receiving the peripheral positioning post 216 of the valve seat 21.

In a variant not shown, no central positioning hole is provided at the center of the central connecting portion 82. The discharge valve includes at least two lugs respectively located between two adjacent valve flaps, and at least two of the lugs are provided with peripheral positioning holes for receiving the peripheral positioning posts.

Preferably, the lug 822 is located between each two adjacent valve flaps 81 and each lug 822 is provided with a peripheral positioning hole 823. As shown in FIG. 12A, the three peripheral positioning holes 823 are evenly spaced at equal angles (120°) with respect to the center of the discharge valve 80. Thus, the installation process of the discharge valve 80 on the valve seat 21 can be simplified, i.e. the discharge valve 80 can take a more flexible mounting direction regardless of the arrangement of the positioning posts on the valve seat 21 in FIG. 11A-11D.

Figure 12A:
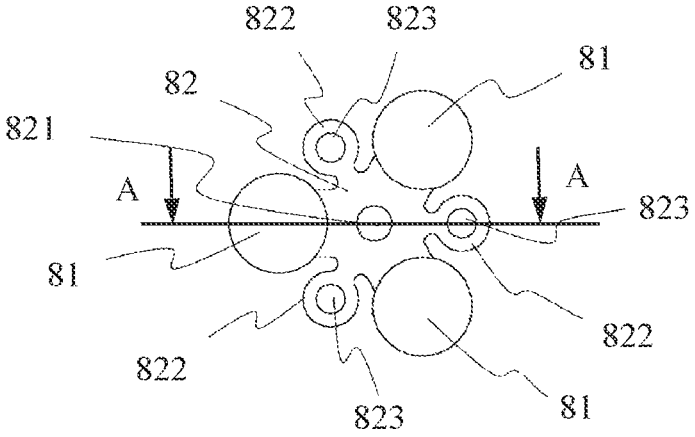
FIG. 12A shows a view of the discharge valve of the micro-fluid pump according to the present disclosure as seen from the pump cover side.
Figure 12B:
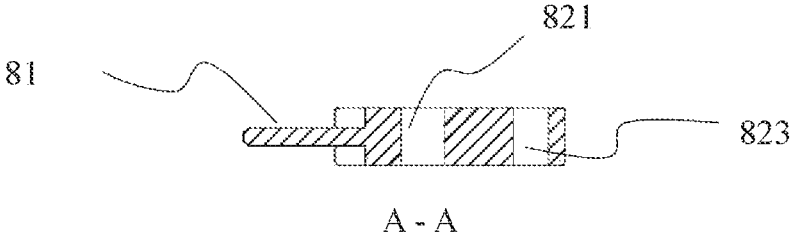
FIG. 12B shows a cross-sectional view of the discharge valve of the micro-fluid pump according to the present disclosure taken through a line A-A in FIG. 12A.

Preferably, when the positioning post structure on the valve seat 21 takes the centrally symmetrical structure shown in FIG. 11B or FIG. 11D, the discharge valve 80 adopts a corresponding central symmetrical structure as shown in FIG. 12A. Such an arrangement realizes a centrally symmetrical retention of the discharge valve 80 as a whole, so that each positioning hole is subjected to force averagely, ensuring stable positioning of the entire discharge valve during operation of the liquid pump and avoiding premature damage of one of the positioning holes leading to the overall failure of the pump.

Of course, it is conceivable to replace the positioning hole of the discharge valve for receiving the valve seat positioning post with a receiving recess. Other forms of mating structure can also be provided in the discharge valve as long as anchoring to the valve seat positioning post can be achieved.

Next, an alternative structure of the valve seat, the diaphragm portion, and the diaphragm seat, and the manner of mounting therebetween will be described with reference to FIGS. 2A-2C in conjunction with FIGS. 13-19. As shown in FIGS. 2A-2C, the valve seat, diaphragm unit, and diaphragm seat are assembled in the orientation shown and the seal between the components must be secured for precisely controlling flow rate. To this end, the diaphragm portion must remain positionally stable during the rapid reciprocating compression-recovery operation of the diaphragm unit and cannot be misaligned with respect to the valve seat and the diaphragm seat. In addition, the compression ratio is also an important indicator affecting the performance of the liquid pump. Advantageously, the present disclosure proposes a valve seat provided with a pressurizing boss, and also a relative positioning structure as to the valve seat, the diaphragm portion and the diaphragm seat such that the three are co-located during assembly so as to press and anchor the diaphragm portion between the valve seat and the diaphragm seat, thereby improving the stability of the diaphragm portion.

Figure 13:
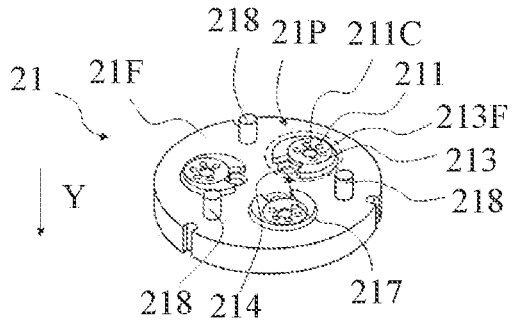
FIGS. 13 and 14 respectively show a perspective view and a bottom view of a valve seat of the micro-fluid pump according to the present disclosure.
Figure 14:
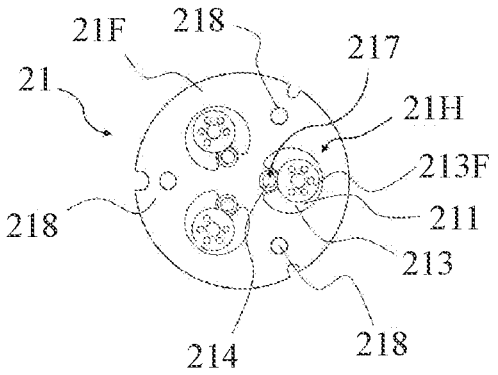

Specifically, referring to FIGS. 13 and 14, the valve seat 21 may be provided with a plurality of through-hole groups 21H symmetric about the center thereof. In the example shown in the drawing, the valve seat 21 is provided with three through-hole groups 21H, and for the sake of clarity, only one of the through-hole groups 21H is identified. Each of the through-hole groups 21H is composed of a liquid discharge hole 214 disposed adjacent to the center of the valve seat and liquid inlet holes 211 disposed radially outward with respect to the liquid discharge hole 214. The liquid discharge hole 214 defines an outflow passage for discharging the liquid, which forms at least a portion of the discharge passage of the liquid pump. The liquid inlet hole 211 defines an inflow passage for liquid to enter, which forms at least a portion of the inlet passage of the liquid pump. The inlet valve 70 may be located between the valve seat 21 and the diaphragm seat 22, and covers the liquid inlet holes 211 from the base surface 21F side of valve seat, facing the diaphragm seat 22. The discharge valve 80 may be located between the valve seat 21 and the pump cover 10, and covers the liquid discharge hole 214 from the side of the top surface opposite to the base surface 21F of the valve seat.

Preferably, the valve seat may be provided with a plurality of compression zones 21P (shown in dashed boxes in the figure) that are symmetric about its center. For the sake of clarity, only one compression zone and its internal structure are identified in detail in the figures. Each of the compression zones 21P corresponds to one diaphragm unit 60U of the diaphragm portion 60, respectively. A pressurizing boss 213 and a notch region 217 partially surrounded by the pressurizing boss 213 are formed in the compression zones 21P, and the pressurizing boss 213 thereby forms a crescent shape as shown in FIG. 13. In the example of FIGS. 13 and 14, the valve seat 21 is provided with three compression zones and three pressurizing bosses 213 that are centrally symmetric about its center, and the plurality of notch regions 217 are also regularly distributed with respect to the geometric center of the valve seat 21.

As can be seen from FIG. 13, the pressurizing boss 213 is raised from the base surface 21F of the valve seat 21 by a height so as to protrude into the corresponding diaphragm unit 60U. In the illustrated embodiment, the notch region 217 is located on a side of the pressurizing boss 213 that is closer to the center of the valve seat. Thereby, the pressurizing boss 213 can form a crescent shape with a notch, and the notch region 217 is sandwiched between the two ends of the crescent.

Each of the pressurizing bosses 213 is provided with an inlet valve seat surface 213F for receiving a corresponding inlet valve 70. The liquid inlet holes 211 are formed in the inlet valve seat surface 213F and penetrate the pressurizing boss 213 in the direction of the axis Y, and the liquid discharge hole 214 is disposed in the notch region. The inlet valve seat surface 213F can be a concave surface having a generally circular boundary such that the inlet valve seat surface 213F can be form-fitted with the respective mounting surface of the inlet valve 70 to mount the inlet valve 70 on the valve seat 21 more stably and compactly. However, although the inlet valve seat surface 213F is formed as a concave surface, it as a whole is still higher than the base surface 21F of the valve seat. In other words, this concave surface has a lowest point in the direction of the axis Y that still higher than the base surface 21F of the valve seat.

In a conventional valve seat design, the portion of the valve seat that corresponds to the compression zone is often designed as a recess that is depressed from the base surface of the valve seat for receiving an inlet valve mounted thereon. According to the present disclosure, the pressurizing boss protrudes from the base surface of the valve seat into the corresponding diaphragm unit, occupying a larger volume in the compression zone than the conventional valve seat. When the diaphragm unit is compressed to the extreme position, the remaining space for accommodating liquid in the diaphragm unit is accordingly reduced, thereby contributing to an increase in the compression ratio of the liquid pump.

Each of the inlet valve seat surface 213F is provided with an inlet valve mounting hole 211C and a plurality of liquid inlet holes 211 surrounding the inlet valve mounting hole 211C. When umbrella stem of the inlet valve 70 is inserted into the inlet valve mounting hole 211C, the mounting surface of the umbrella skirt valve flap fits over the inlet valve seat surface 213F and covers the respective liquid inlet holes 211. The discharge valve 80 covers the liquid discharge holes 214 on the surface of the valve seat opposite to the base surface 21F. The center of each of the liquid discharge holes 214 is in the same radial direction on the valve seat 21 as the center of the corresponding inlet valve seat surface 213F. Also, the liquid discharge hole 214 is disposed adjacent to the inlet valve seat surface 213F. Such an arrangement makes the spatial arrangement of the inlet and outlet passages for the liquid on the valve seat more compact, thereby facilitating the reduction of the overall size of the pump body.

It should be understood that, since the liquid inlet holes 211 are provided on the inlet valve seat surface 213F and penetrates the pressurizing boss 213 and the liquid discharge holes 214 are provided in the notch region 217 on the base surface 21F of the valve seat, the depth through which the liquid inlet holes 211 penetrate is greater than the depth through which the liquid discharge holes 214 penetrate.

Next, another embodiment of the diaphragm portion will be described with reference to FIGS. 15 to 18. As shown, the diaphragm mounting 61 may have a flat form and be disposed on an open side of the diaphragm unit 60U. The diaphragm portion 60 and the diaphragm seat 22 are designed such that when the diaphragm portion 60 is mounted on the diaphragm seat, the diaphragm unit 60U can be accommodated in the corresponding mounting hole 22H in the diaphragm seat 22 while the bottom surface 61F of the diaphragm mounting 61 may be fitted to the grooved surface 22F of the diaphragm seat 22.

Whether the diaphragm portion 60 can be stably maintained in the diaphragm seat 22 is an important factor affecting the performance of the micro-liquid pump. When the liquid pump 100 is in operation, the wall of the cavity of each of the diaphragm units 60U is successively subjected to a vigorous and rapid compression movement by the crank 231, so the edge of the diaphragm mounting 61, the periphery of the diaphragm units 60U, and the like may be deformed, for example, eversion may occur, and even after the valve seat 21 is mounted to the diaphragm seat 22 to press the diaphragm portion 60 tightly, the eversion may not be completely avoided. At the same time, during operation of the liquid pump 100, the diaphragm portion 60 may be moved in translation on the diaphragm seat 22 also due to the vigorous and rapid deformation of the cavity wall of each diaphragm unit 60U. All these deformations or movements may cause fluid to leak from the diaphragm portion 60, which significantly reduces the accuracy of the liquid pump and thereby reduces its performance.

In view of this, the present disclosure proposes a stable positioning device for diaphragm portion.

As shown in FIGS. 13 and 14, the valve seat 21 may be provided with a positioning post 218 between every two adjacent compression zones 21P. In the example shown in the figures, three positioning posts 218 are provided on the valve seat 21. The positioning posts 218 project from the bottom surface 21F of the valve seat 21 in the direction of the axis Y. Correspondingly, the diaphragm portion 60 is provided with a plurality of positioning holes 615 (see FIGS. 15 and 16) on the diaphragm mounting 61 and the diaphragm seat 22 is provided with a plurality of positioning recesses 225 on the grooved surface 22F (see FIGS. 17 and 18). As used herein, "correspondingly" means that when the diaphragm portion 60 is mounted between the diaphragm seat 22 and the valve seat 21, the corresponding positioning devices on the three components can be matched to each other, that is, the positioning posts 218 on the valve seat 21 can pass through the positioning holes 615 on the diaphragm portion 60 in the direction of the axis Y, and fits in the positioning recesses 225 on the diaphragm seat. Of course, other similar forms of structure may be used to achieve the above positioning. For example, a positioning post, a positioning hole, and a positioning recess may be respectively disposed on the diaphragm seat, the diaphragm portion and the valve seat.

In the positioning device adopting such a design, the positioning of the diaphragm portion may be achieved by means of the cooperation of the positioning components respectively located on the valve seat, the diaphragm portion and the diaphragm seat due to the additional positioning component on the valve seat, thus the diaphragm is pressed tightly and anchored between the valve seat and the diaphragm seat so as to further improve the stability of positioning of the diaphragm portion, as compared with the conventional positioning device in which the positioning components are only provided in the diaphragm seat and the diaphragm portion.

Furthermore and preferably, the mounting groove 227 for the snap spring and the positioning recess 225 are located in the same radial direction of the diaphragm seat 22. Thereby, the diaphragm portion is fixed by at least two positioning structures in the same radial direction, that is, the above through-type positioning structure between the adjacent two diaphragm units and the snap spring positioning structure, so that the cooperation between the valve seat, the diaphragm portion and the diaphragm seat is made more stable. At the same time, the through-type positioning structure can be further strengthened by arranging the snap spring positioning structure in the same radial direction as the through-type positioning structure.

Figure 15:
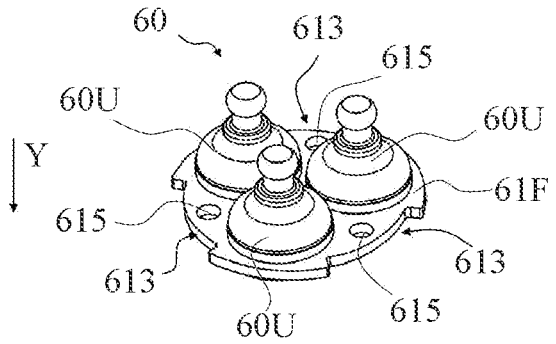
FIGS. 15 and 16 respectively show a perspective view and a bottom view of a diaphragm portion of the micro-fluid pump according to the present disclosure.
Figure 16:
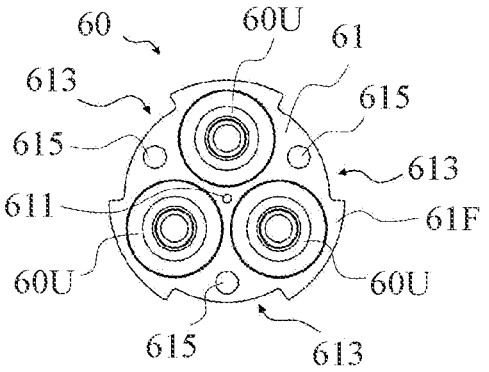

In the embodiment shown in FIGS. 15 and 16, the respective positioning holes 615 are equally spaced at an angle at a circumference centered on the center of the diaphragm portion, for example an angle of 120°. Correspondingly, the positioning posts 218 and the positioning recesses 225 are also equally spaced at an angle at a circumference centered on the center of the valve seat and that centered on the center of the diaphragm seat, for example an angle of 120°. Such an arrangement realizes a centrally symmetrical retention of the diaphragm portion as a whole, so that each positioning hole is subjected to force averagely to prevent premature damage of one of the positioning holes to cause displacement or even tear of the diaphragm portion.

Furthermore, the center of each of the positioning holes 218 may be distributed on or outside the circumference of a circle defined by the geometric center of each of the diaphragm units 60U. Correspondingly, the centers of the respective positioning recesses 225 are also distributed on or outside the circumference of the circle defined by the geometric center of each of the mounting holes 22H. Thereby, the anchor points of the diaphragm portion on the diaphragm seat can be distributed over a wide range, which effectively reduces the risk of deformation of the edge of the diaphragm mounting 61 and further improve the reliability of the positioning structure.

Figure 17:
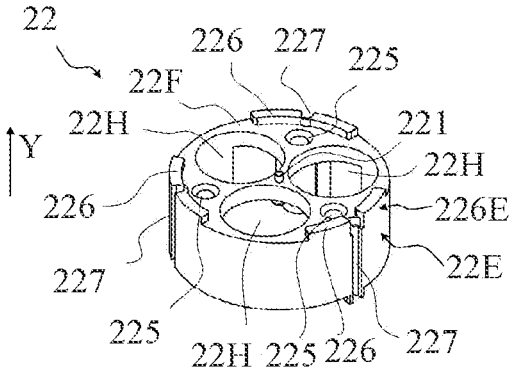
FIGS. 17 and 18 respectively show a perspective view and a top view of one embodiment of a diaphragm seat of a micro-fluid pump according to the present disclosure.
Figure 18:
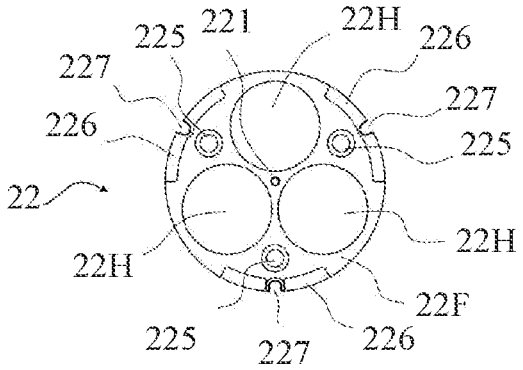

According to one embodiment of the present disclosure, the diaphragm seat 22 may further include a central positioning device at its center, such as the central positioning protrusion 221 shown in FIGS. 17 and 18 which protrudes from the grooved surface 22F of the diaphragm seat 22 in the direction of the axis Y. Accordingly, referring to FIG. 16, the diaphragm portion 60 may be provided at its center with a center hole 611 for receiving the above-described central positioning protrusion 221. Alternatively, the diaphragm portion 60 may be provided at its center with a central recess (not shown) for receiving the above-described central positioning protrusion 221.

Of course, the central positioning device may also be provided in a similar manner to the aforementioned positioning post 218 on the valve seat 21, the positioning hole 615 on the diaphragm portion 60 and the positioning recess 225 on the diaphragm seat. According to a variant embodiment (not shown), the valve seat may comprise a central positioning protrusion at its center, which is capable of passing through respective central positioning hole at the center of the diaphragm seat in the direction of the axis Y, thereby engaging into respective central recess at the center of the diaphragm seat.

With continued reference to FIGS. 17-18, the diaphragm seat may also comprise a peripheral flange section 226 that extends along the circumference of its grooved surface 22F. As shown in FIG. 17, the peripheral flange section 226 is raised from the grooved surface 22F of the diaphragm seat by a height in the direction of the axis Y. Additionally, the radially outer surface 226E of the peripheral flange section 226 is flush with the radially outer surface 22E of the diaphragm seat 22. Preferably, a plurality of peripheral flange sections 226 circumferentially cover between each two adjacent mounting holes, that is, the plurality of peripheral flange sections 226 are circumferentially located between each two adjacent mounting holes 22H, and are regularly distributed with respect to the center of the diaphragm seat 22. Accordingly, referring to FIGS. 15 and 16, the diaphragm portion 60 has peripheral notch sections 613 extending along its circumference (in other words, along the outer circumference of the diaphragm mounting 61). As used herein, "corresponding" means that the peripheral notch section 613 is configured to be complementary in shape to the peripheral flange section 226. Thus, when the diaphragm portion 60 is mounted on the diaphragm seat 22, the peripheral flange section 226 of the diaphragm seat and the peripheral notch section 613 on the diaphragm portion are engaged with each other, whereby the two components are not only aligned along the longitudinal axis Y, but also are constrained in a transverse plane perpendicular to the longitudinal axis Y, thereby preventing translation and torsion of the diaphragm portion 60 on the diaphragm seat 22 during use so as to effectively prevent the eversion of the diaphragm portion 60.

Figure 19:
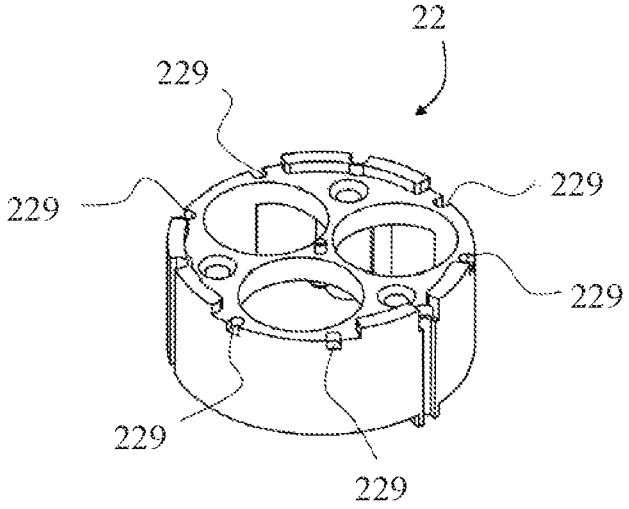
FIG. 19 shows a perspective view of one embodiment of a diaphragm seat of a micro-fluid pump according to the present disclosure.

Alternatively, the positioning of the peripheral portion of the diaphragm portion is provided in another manner. As shown in FIG. 19, the diaphragm seat 22 may be provided with a plurality of peripheral positioning grooves 229 on the outer circumference of the grooved surface 22F. Accordingly, the diaphragm portion 60 may comprises a peripheral positioning protrusions (not shown) provided on the periphery thereof (in other words, along the outer circumference of the diaphragm mounting 61). Peripheral positioning protrusion can be received in corresponding peripheral positioning grooves 229 on the periphery of the diaphragm seat.

What are described above is related to the illustrative embodiments of the disclosure only and not limitative to the scope of the disclosure; the scopes of the disclosure are defined by the accompanying claims.

What is claimed is:

1. A micro-fluid pump capable of controlling flow precisely, wherein said micro-fluid pump comprises:

a motor for providing power for an operation of said micro-fluid pump; and a pump body mounted to the motor and comprising a diaphragm assembly including:

a diaphragm portion regularly arranged with a plurality of compressible diaphragm units around its center, each of said diaphragm units having a cavity with an opening, a compression body, and a flexible cavity wall between said opening and said compression body, said cavity wall comprising a uniform thickness portion and a linear thickened portion adjacent to the opening; and a diaphragm seat having a receiving side which is provided with a receiving recess for receiving said diaphragm portion, wherein the receiving recess is provided with a plurality of mounting holes for accommodating the cavity walls of the respective diaphragm unit;

wherein said diaphragm assembly further comprises a diaphragm deformation control structure including:

the linear thickened portions of the cavity walls of the cavities of said diaphragm units;

linear portions of inner side walls of said mounting holes which cooperate with said linear thickened portions, for controlling deformation of upper portions of the cavity walls; and portions for avoiding expansion of the inner side walls of said mounting holes that cooperates with said uniform thickness portions;

wherein said uniform thickness portions of the cavity walls have a thickness of 0.5 mm, said linear thickened portions have a length in a longitudinal direction of 0.9 mm, and said linear portions of the inner side walls of said mounting holes have a length in the longitudinal direction of 0.85 mm.

2. The micro-fluid pump according to claim 1 capable of controlling flow precisely, wherein said diaphragm units have a circular cross section; said linear thickened portion have an outer diameter of 10.1 mm, and a linear portions of the inner side walls of said mounting holes have an inner diameter of 10.2 mm, and/or said diaphragm portion has a diaphragm mounting that integrally connects the respective diaphragm units and is received in said receiving recess, said diaphragm mounting having a length of 1.2 mm in the longitudinal direction.

3. A micro-fluid pump capable of controlling flow precisely, wherein said micro-fluid pump comprises:

a pump body, and a pump cover covering the pump body to form at least a portion of an inlet passage and at least a portion of a discharge passage, said pump cover comprising an inlet cavity for containing fluid entering the micro-fluid pump from outside and a discharge cavity for containing the fluid to be discharged from the micro-fluid pump, separated by a partition portion;

wherein said pump cover has on its bottom face a distribution wall which is disposed in said inlet cavity and extends at least partially toward said partition portion;

wherein the micro-fluid pump further comprises a motor for providing power for an operation of said micro-fluid pump;

wherein said pump body is mounted to the motor and comprises a diaphragm assembly comprising:

a diaphragm portion regularly arranged with a plurality of compressible diaphragm units around its center, each of said diaphragm units having a cavity with an opening, a compression body and a flexible cavity wall between said opening and said compression body, said cavity wall comprising a uniform thickness portion and a linear thickened portion adjacent to the opening; and a diaphragm seat having a receiving side which is provided with a receiving recess for receiving said diaphragm portion, wherein the receiving recess is provided with a plurality of mounting holes for accommodating the cavity walls of the respective diaphragm units;

wherein said diaphragm assembly further comprises a diaphragm deformation control structure comprising:

the linear thickened portions of the cavity walls of the cavities of said diaphragm units;

linear portions of inner side walls of said mounting holes which cooperate with said linear thickened portions, for controlling deformation of upper portions of the cavity walls; and portions for avoiding expansion of the inner side walls of said mounting holes that cooperate with said uniform thickness portions; and wherein said uniform thickness portions of the cavity walls have a thickness of 0.5 mm, said linear thickened portions have a length in a longitudinal direction of 0.9 mm, and said linear portions of the inner side walls of said mounting holes have a length in the longitudinal direction of 0.85 mm.

4. The micro-fluid pump of claim 3 capable of controlling flow precisely, wherein the pump cover has a plurality distribution walls which are spaced at a regular angle with respect to a center of said pump cover in order to divide said inlet cavity into a plurality of inlet sub-cavities.

5. The micro-fluid pump according to claim 3 capable of controlling flow precisely, wherein said micro-fluid pump is assembled by a snap spring, and a recess for the snap spring is provided on a top face of said pump cover, a position of said recess corresponding to a position of the distribution wall on the bottom face of said pump cover.

6. The micro-fluid pump according to claim 3 capable of controlling flow precisely, wherein said pump body comprises a valve seat on which an outflow passage for discharging the fluid is provided, said outflow passage forming at least a portion of the discharge passage of said micro-fluid pump, said valve seat is further mounted with a one-way discharge valve which is located between said valve seat and said pump cover and has a flexible valve flap covering said outflow passage, a side of said valve flap facing the valve seat and covering the outflow passage being formed as a spark surface.

7. The micro-fluid pump of claim 3 capable of controlling flow precisely, wherein said inlet cavity is disposed around said discharge cavity and has an inlet cavity outer wall from which said distribution wall extend partially toward said partition portion or to said partition portion.

8. The micro-fluid pump of claim 3 capable of controlling flow precisely, wherein said distribution wall extends radially.

9. The micro-fluid pump of claim 3 capable of controlling flow precisely, wherein said pump body comprises:

a valve seat which is provided with a plurality of through-hole groups, each of which comprises a liquid inlet hole for liquid inflow and a liquid discharge hole for discharging liquid; and wherein said valve seat is provided with positioning posts between each two adjacent through-hole groups, said positioning posts are able to pass through corresponding positioning holes on said diaphragm portion to fit into corresponding positioning recesses on said diaphragm seat.

10. The micro-fluid pump of claim 3 capable of controlling flow precisely, wherein said pump body comprises:

a valve seat on which a plurality of compression zones are distributed, each of which corresponds to one of the plurality of diaphragm units and provided with a liquid inlet hole for the liquid inflow covered with an inlet valve, and a liquid discharge hole for discharging the liquid covered with a discharge valve; and wherein said compression zone is provided with a pressurizing boss and a notch region partially surrounded by the pressurizing boss, and said pressurizing boss protrudes from a base surface of the valve seat into the corresponding diaphragm unit and provided an inlet valve seat surface, which is higher than a bottom surface of said valve seat, for receiving said inlet valve thereon, said liquid inlet hole is provided in the inlet valve seat surface and penetrates said pressurizing boss, and said liquid discharge hole is opened in said notch region.

11. The micro-fluid pump of claim 3 capable of controlling flow precisely, wherein said micro-fluid pump is a liquid pump and said pump body comprises a valve assembly which comprises:

a valve seat with a liquid discharge cavity formed thereon, said liquid discharge cavity is formed with a plurality of liquid discharge holes therein defining a portion of the liquid discharge passage, and a discharge valve installed in the liquid discharge cavity and having a plurality of valve flaps which cover the plurality of liquid discharge holes, wherein at least two separate protruding positioning posts are disposed in said liquid discharge cavity, and at least two receiving portions are disposed in said discharge valve, said at least two receiving portions being configured to receive at least two separate positioning posts of the valve seat.

12. The micro-fluid pump of claim 11 capable of controlling flow precisely, wherein said at least two receiving portions are formed as a through-hole or a receiving recess.

13. The micro-fluid pump of claim 3 capable of controlling flow precisely, wherein said pump body comprises a valve seat having a fluid passage for introducing the fluid and/or for discharging the fluid, and wherein said valve seat is provided with a one-way valve for the respective corresponding fluid passage which is an umbrella valve with an umbrella face which has a first side covering the respective fluid passage, said first side being formed as a knife grain surface.

14. The micro-fluid pump of claim 13 capable of controlling flow precisely, wherein said knife grain surface has knife grains in a form of concentric circles or helices.

15. The micro-fluid pump of claim 13 capable of controlling flow precisely, wherein said one-way valve has an umbrella stem which extends along an axis, said first side has an annular inclined face that is inclined away from the umbrella stem and has an angle of 1.20 to 1.60 degrees with respect to a plane perpendicular to the axis of said umbrella stem.

16. The micro-fluid pump of claim 11 capable of controlling flow precisely, wherein said at least two positioning posts are all peripheral positioning posts, each of which is disposed between the two adjacent liquid discharge holes and at a distance from the center of said liquid discharge cavity, and wherein said discharge valve has a central connecting portion for connecting the plurality of valve flaps and at least two lugs, at least two of said lugs being provided with a peripheral receiving portion for receiving the peripheral positioning post.

17. The micro-fluid pump of claim 11 capable of controlling flow precisely, wherein said at least two positioning posts comprise a center positioning post disposed at a center of said liquid discharge cavity and a peripheral positioning post disposed between the two adjacent liquid discharge holes at a distance from the center of said liquid discharge cavity, and wherein said discharge valve has a central connecting portion for connecting the plurality of valve flaps and at least one lug between two adjacent valve flaps, said central connecting portion is provided at its center with a center receiving portion for receiving said center positioning post, and at least one of said lugs is provided with a peripheral receiving portion for receiving the peripheral positioning post.

18. The micro-fluid pump of claim 17 capable of controlling flow precisely, wherein said central connecting portion comprises a plurality of lugs, each of which is located between every two adjacent valve flaps and is provided with a peripheral receiving portion for receiving the peripheral positioning post.

* * * * *